US009136609B2

(12) United States Patent
Ando et al.

(10) Patent No.: US 9,136,609 B2
(45) Date of Patent: Sep. 15, 2015

(54) RESONATOR ANTENNA

(75) Inventors: Noriaki Ando, Tokyo (JP); Hiroshi Toyao, Tokyo (JP)

(73) Assignee: NEC CORPORATION, Tokyo (JP)

( * ) Notice: Subject to any disclaimer, the term of this patent is extended or adjusted under 35 U.S.C. 154(b) by 147 days.

(21) Appl. No.: 13/255,147

(22) PCT Filed: Mar. 29, 2010

(86) PCT No.: PCT/JP2010/002278

§ 371 (c)(1),
(2), (4) Date: Sep. 7, 2011

(87) PCT Pub. No.: WO2010/116675

PCT Pub. Date: Oct. 14, 2010

(65) Prior Publication Data

US 2012/0007786 A1 Jan. 12, 2012

(30) Foreign Application Priority Data

Mar. 30, 2009 (JP) ..... 2009-081858

(51) Int. Cl.

| | |
|---|---|
| ***H01Q 9/00*** | (2006.01) |
| ***H01Q 15/02*** | (2006.01) |
| ***H01Q 15/00*** | (2006.01) |
| ***H01Q 9/04*** | (2006.01) |

(52) U.S. Cl.

CPC ..... *H01Q 15/008* (2013.01); *H01Q 9/0407* (2013.01); *H01Q 9/0457* (2013.01)

(58) Field of Classification Search

CPC .. H01Q 9/0407; H01Q 15/008; H01Q 9/0457
See application file for complete search history.

(56) References Cited

U.S. PATENT DOCUMENTS

| | | | | |
|---|---|---|---|---|
| 6,262,495 | B1 | 7/2001 | Yablonovitch et al. | |
| 6,476,771 | B1 * | 11/2002 | McKinzie, III | 343/756 |
| 6,906,674 | B2 * | 6/2005 | McKinzie et al. | 343/767 |
| 7,463,213 | B2 * | 12/2008 | Nakano et al. | 343/909 |
| 7,760,140 | B2 * | 7/2010 | Kamgaing | 343/700 MS |
| 7,848,737 | B2 * | 12/2010 | Ramos Robles et al. | 455/411 |
| 2002/0167457 | A1 * | 11/2002 | McKinzie et al. | 343/909 |
| 2003/0197658 | A1 * | 10/2003 | Lilly et al. | 343/909 |
| 2004/0095282 | A1 * | 5/2004 | Fukushima et al. | 343/702 |
| 2005/0134522 | A1 | 6/2005 | Waltho | |
| 2007/0285318 | A1 * | 12/2007 | Sotoudeh et al. | 343/702 |
| 2007/0285336 | A1 * | 12/2007 | Kamgaing | 343/895 |
| 2012/0032865 | A1 * | 2/2012 | Toyao et al. | 343/835 |

FOREIGN PATENT DOCUMENTS

| | | | |
|---|---|---|---|
| JP | 2004096168 | A | 3/2004 |
| JP | 2005094360 | A | 4/2005 |
| WO | 02103846 | A | 12/2002 |

OTHER PUBLICATIONS

International Search Report for PCT/JP2010/002278 mailed Jun. 29, 2010.

* cited by examiner

*Primary Examiner* — Trinh Dinh
(74) *Attorney, Agent, or Firm* — Sughrue Mion, PLLC

(57) ABSTRACT

A meta-material (110) is constituted by a conductor plane (103) on the lower side, a conductor (102) on the upper side, a repeated (for example, periodic) array of conductor strips (104), and conductor posts (105) which electrically connect each of the conductor strips (104) and the conductor plane (103) on the lower side. A power feed line (106) is connected to the conductor (102). Openings may be repeatedly provided in the conductor plane (103) on the lower side. In this case, an island-shaped electrode is provided within the opening, and the conductor post (105) is connected to the conductor plane (103) through the island-shaped electrode.

8 Claims, 31 Drawing Sheets

(a)

(b)

(a)

(b)

(a)

(b)

RESONATOR ANTENNA

CROSS-REFERENCE TO RELATED APPLICATIONS

This application is a national stage application of International Application No. PCT/JP2010/002278 entitled "Resonator Antenna," filed on Mar. 29, 2010, which claims the benefit of the priority of Japanese Patent Application No. 2009-081858, filed on Mar. 30, 2009, the disclosures of each of which are hereby incorporated by reference in their entirety.

TECHNICAL FIELD

The present invention relates to a resonator antenna in which a meta-material is used.

BACKGROUND ART

In recent years, in wireless devices and the like, miniaturization and thinning of antennas have been required. This is caused by the fact that securing space is difficult to due to the high packaging density, an increase in the number of antennas due to introduction of a multiple input multiple output (MIMO), and the like. Such a tendency is remarkable, particularly, in mobile applications in which miniaturization, lighter weights, and thinning are required, and thus miniaturization and thinning of antennas are essential.

In resonator antennas such as a related art type patch antenna or a wire antenna, the operating band thereof depends on the element size, and the dielectric constant and the magnetic permeability of an insulating material (dielectric). Therefore, the operating band and the used substrate material are determined, the size thereof also is naturally determined.

FIG. 2 shows a related art type patch antenna 1*a*. It is constituted by two conductor layers. A patch-shaped conductor element 2 which is an antenna element is disposed in the upper layer and a conductor plane 3 is disposed in the lower layer with a dielectric layer 14 interposed therebetween, and a region surrounded by the dotted line forms a resonator 12. In addition, the conductor element 2 is electrically connected to a power feed line 6. In an example of the drawing, power is fed to the conductor element 2 by a microstrip line.

Generally, since the carrier frequency used in wireless devices is in a range of a few GHz or less, the size equivalent to a half-wavelength $\lambda/2$ in a vacuum is a few cm or so in a vacuum. Here, when the dielectric constant of the dielectric layer 14 is set to $\epsilon r$, and the magnetic permeability is set to $\mu r$, the length d of one side of the resonator 12 during half-wavelength resonance is expressed by the following expression.

$$d=\lambda/(2\cdot(\epsilon r\cdot\mu r)^{1/2})$$

Therefore, in order to drastically miniaturize the related art type antenna, it is required to use a medium having an extremely high dielectric constant and magnetic permeability, and thus it costs too much.

On the other hand, in recent years, it is proposed to use the high-impedance surface (hereinafter, referred to as HIS) as a method for improving the low profile or directionality of the antenna. The HIS is also referred to as an artificial magnetic conductor (AMC). As a structure for implementing the HIS, a mushroom-type periodic structure 10 disclosed in Patent Document 1 is known. The mushroom-type periodic structure 10 is also known as one of the typical structures of an electromagnetic bandgap (EBG) structure.

Patent Document 1 discloses that while a normal conductor causes electromagnetic waves to be reflected in reverse phase, the mushroom-type periodic structure 10 causes electromagnetic waves in the vicinity of the bandgap frequency to be reflected in phase, and functions as a magnetic wall and suppresses propagation of the surface current in the bandgap frequency band of the mushroom-type periodic structure 10.

FIG. 3 shows a cross-sectional view of the mushroom-type periodic structure 10. The mushroom-type periodic structure 10 has a structure in which it is constituted by two conductor layers, the periodic array of conductor strips 4 is disposed on the upper layer, the conductor plane 3 is disposed on the lower layer, and each of the conductor strips 4 is electrically connected to the conductor plane 3 by a conductor post 5. As a shape of the conductor strip 4, a regular hexagonal shape or a square shape, and the like are proposed.

FIG. 4 (*a*) shows a patch antenna 11 disclosed in FIG. 11*b* of Patent Document 1. In the example shown in the drawing, the power feed line 6 passes through the dielectric layer 14 so as to be connected to the coaxial cable 16. The mushroom-type periodic structure 10 is disposed so as to surround the conductor element 2 which is an antenna element, whereby propagation of the surface current is suppressed. Thereby, it is known from Patent Document 1 and the like that unnecessary radiation from the end or the rear of the conductor plane 3 is suppressed, and that directionality or radiation efficiency of the antenna is improved.

FIG. 4 (*b*) shows a wire antenna 21 disclosed in FIG. 8*b* of Patent Document 1. The operating frequency of the antenna, that is, the resonance frequency of the resonator 12 and the frequency at which the mushroom-type periodic structure 10 functions as a magnetic wall are matched with each other, whereby it is possible to use the mushroom-type periodic structure 10 as a reflective plate functioning as a magnetic wall. It is known from Patent Document 1 and the like that when a normal conductor plane is used as a reflective plate of the antenna, it is required to set the conductor element 2 apart from the conductor plane 3 to a height of a quarter wavelength in order to enhance the radiation efficiency, and on the other hand, when the mushroom-type periodic structure 10 functioning as a magnetic wall is used as a reflective plate, the radiation efficiency is enhanced at the time of bringing the conductor element 2 close to the mushroom-type periodic structure 10, thereby allowing a lower profile to be obtained in the antenna.

Moreover, in the wire antenna 21, the propagation of the surface current is also suppressed by the mushroom-type periodic structure 10. Thereby, it is known from Patent Document 1 and the like that the unnecessary radiation from the end or the rear of the conductor plane 3 is suppressed, and that directionality or radiation efficiency of the antenna is improved.

RELATED DOCUMENT

Patent Document

[Patent Document 1] U.S. Pat. No. 6,262,495 Specification (FIGS. 8*b* and 11*b*)

DISCLOSURE OF THE INVENTION

In the case of the patch antenna 1*a* shown in FIG. 2(*a*) and the patch antenna 11 shown in FIG. 4(*a*) exemplified in FIG. 11*b* of Patent Document 1, since the half-wavelength resonance is used, the size itself of the antenna element does not change compared to an antenna in the related art in which the conductor plane is used as a reflective plate, and thus it is difficult to miniaturize the antenna element.

In addition, in the wire antenna 21 shown in FIG. 4(*b*) exemplified in FIG. 8*b* of Patent Document 1, since the mushroom-type periodic structure 10 is used as a reflective plate, the area occupied by the mushroom-type periodic structure becomes spontaneously considerably larger than the area occupied by the conductor element 2 which is an antenna element. That is, in the antenna in which the mushroom-type structure is used as a magnetic wall, the lower profile can be realized in the antenna. However, it is required to provide the mushroom-type periodic structure over a wide region, and thus the miniaturization is difficult.

An object of the invention is to provide a resonator antenna which is capable of miniaturizing the antenna element, and suppressing the area occupied by the mushroom-type periodic structure to be equal to or less than a size of the antenna element.

A resonator antenna of the invention includes: a first conductor; a second conductor of which at least a, portion faces the first conductor; a third conductors repeatedly arranged between the first conductor and the second conductor; a power feed line electrically connected to the first conductor or the second conductor; and a first connection member that electrically connects a conductor strip and the first conductor to each other.

According to the invention, it is possible to miniaturize the antenna element, and to suppress the area occupied by the mushroom-type periodic structure to be equal to or less than a size of the antenna element.

BRIEF DESCRIPTION OF THE DRAWINGS

FIG. 13(*b*) is a top view illustrating various shapes of the plane-type inductance element.

FIG. 13(*c*) is a top view illustrating various shapes of the plane-type inductance element.

FIG. 16(*b*) is a cross-sectional view illustrating the resonator antenna according to the fourth embodiment.

FIG. 16(*c*) is a cross-sectional view illustrating the resonator antenna according to the fourth embodiment.

FIG. 16(*d*) is a cross-sectional view illustrating the resonator antenna according to the fourth embodiment.

DESCRIPTION OF EMBODIMENTS

Next, embodiments for carrying out the invention will be described in detail with reference to the drawings. First, a resonator antenna according to the invention is a resonator antenna having a meta-material constituted by a periodic structure, and a conductor element 102 is equivalent to an element.

Figure 1:
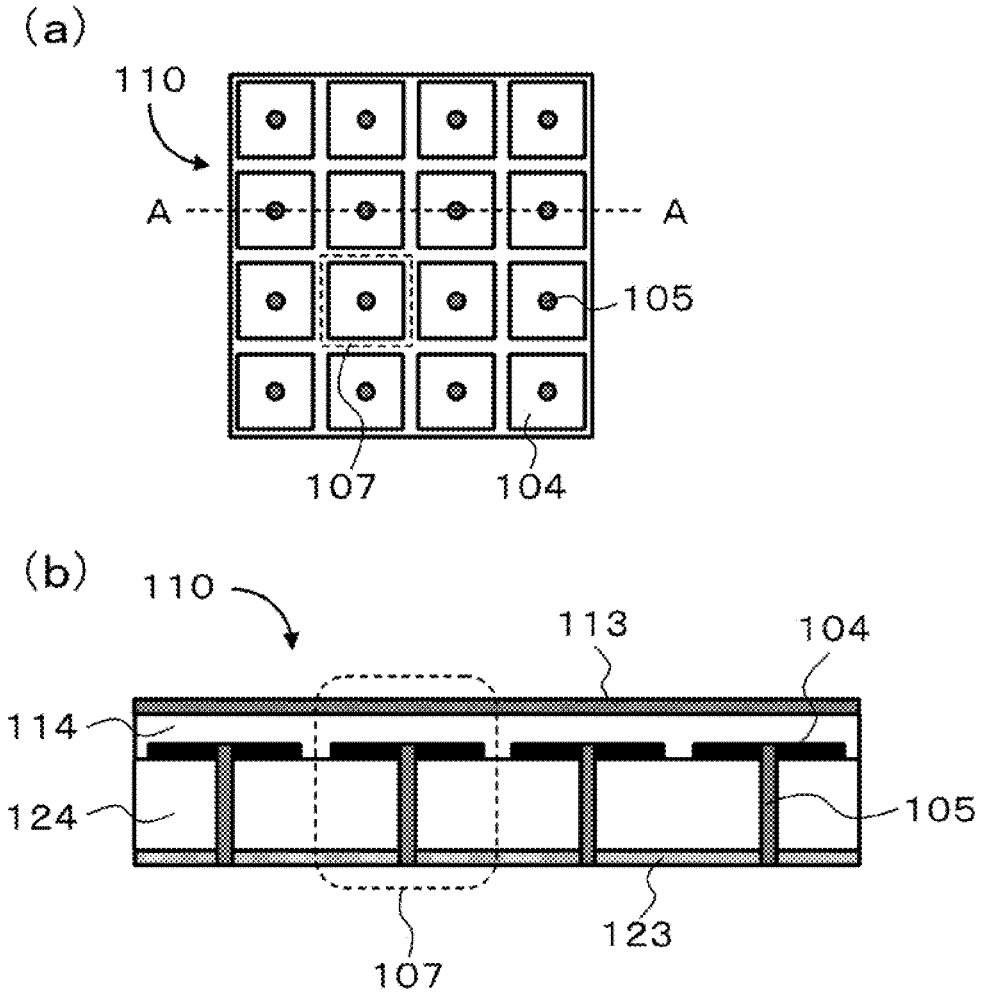
FIG. 1 is a diagram illustrating a meta-material used in an embodiment of a resonator antenna according to the invention.

FIG. 1(*a*) shows a top view when a meta-material 110 used in the resonator antenna according to the invention is seen through the upper surface, and FIG. 1(*b*) shows a cross-sectional view taken along the A-A line. The meta-material 110 is constituted by a first conductor plane (first conductor) 113 on the upper side, a second conductor plane (second conductor) 123 on the lower side, a repeated (for example, periodic) array of conductor strips (third conductors) 104, and conductor posts (first connection members) 105 that electrically connect the second conductor plane 123 on the lower side to each of the conductor strips 104. The periodic array of the conductor strips 104 is disposed in a layer located between the first conductor plane 113 on the upper side and the second conductor plane 123 on the lower side. In addition, a first dielectric layer 114 is formed between the first conductor plane and a periodic array layer of the conductor strips 104, and a second dielectric layer 124 is formed between the periodic array layer of the conductor strips 104 and the second conductor plane.

A region surrounded by the dashed line in FIGS. 1 (*a*) and 1 (*b*) represents a unit cell 107 of the meta-material 110, and the meta-material 110 is formed by repeatedly, for example, periodically arranging the unit cell 107 two-dimensionally (or one-dimensionally).

Herein, when the "repeated" unit cells 107 are disposed, it is preferable that in the unit cells 107 adjacent to each other, the same via distance (center-to-center distance) is set so as to be within a range of the ½ wavelength λ in the communication frequency of the antenna. In addition, a case in which a portion of the configuration is missing in any of the unit cells 107 is also included in "repeated". In addition, when the unit cells 107 have a two-dimensional array, a case in which the unit cells 107 are partially missing is also included in "repeated". In addition, a case in which a portion of the components is out of alignment in some unit cells 107 or a case in which the arrangement of some unit cells 107 themselves is out of alignment is also included in "periodic". That is, even when periodicity in a strict sense breaks down, it is possible to obtain the characteristics as a meta-material in the case in which the unit cells 107 are repeatedly disposed, and thus a certain level of defects is allowed in "periodicity". Meanwhile, as causes for occurrence of the defects, a case of passing through the interconnects or the vias between the unit cells 107, a case in which the unit cells 107 cannot be disposed through the existing vias or patterns when the meta-material structure is added to the existing interconnect layout, a case in which manufacturing errors and the existing vias or patterns are used as a portion of the unit cells 107, and the like may be considered.

Figure 5:
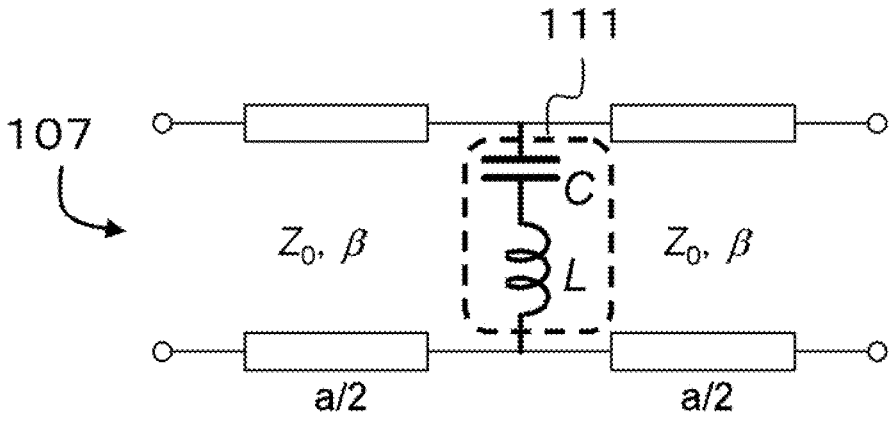
FIG. 5 is an equivalent circuit diagram per unit cell of the meta-material used in the resonator antenna according to the embodiment.

FIG. 5 shows an equivalent circuit per unit cell 107 of the meta-material 110. The equivalent circuit can be represented in a form in which a serial resonance circuit 111 is shunted in the center portion of the transmission line. The capacitance formed between the conductor strip 104 and the first conductor plane 113 is equivalent to the capacitance C in the equivalent circuit of the meta-material 110 shown in FIG. 5. In addition, the inductance based on the conductor post 105 located between the conductor strip 104 and the second conductor plane 123 is equivalent to the inductance L in FIG. 5. That is, the conductor strips 104 and the conductor posts 105 exist in the layer located between the first conductor plane 113 and the second conductor plane 123, whereby the parallel plate has a structure which is periodically shunted by the serial resonance circuit 111 formed of the capacitance C and the inductance L.

Figure 6:
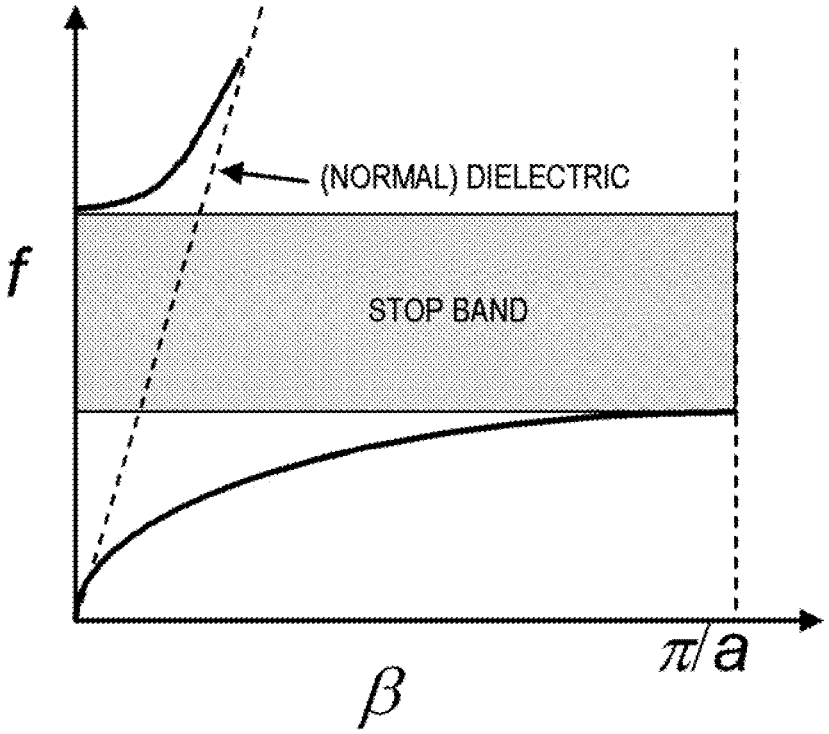
FIG. 6 is a dispersion curve of the meta-material used in an embodiment of the resonator antenna according to the embodiment.

FIG. 6 shows a dispersion curve obtained by comparing propagation characteristics of electromagnetic waves propagating through the meta-material 110 or the parallel-plate waveguide. In FIG. 6, the solid lines indicate the dispersion relationship of the meta-material 110, and a case in which the infinite unit cells 107 are periodically arranged is assumed. On the other hand, the dashed line indicates the dispersion relationship in the parallel-plate waveguide in which the conductor strips 104 and the conductor posts 105 in FIG. 1(*b*) are removed.

In the case of the parallel-plate waveguide indicated by the dashed lines, the wave number and the frequency are expressed by the straight lines because they have a proportional relationship to each other, and the slope thereof is expressed by the following expression.

$$f/\beta = c/(2\pi\cdot(\epsilon r\cdot\mu r)^{1/2})$$

On the other hand, in the case of the meta-material 110, as the frequency rises, the wave number rapidly increases compared to that of the parallel-plate waveguide indicated by the dashed line. When the wave number reaches 2π/a, the frequency band equal to or higher than this becomes a stop band, and when the frequency further rises, a passband appears. That is, in the frequency band equal to or less than the stop band, the wavelength of an electromagnetic wave propagating through the structure of the invention becomes drastically shorter than that of the case in which the conductor strip and the conductor post do not exist. The characteristics are shown that with respect to the passband appearing at the lowest-frequency side, the phase velocity becomes lower than the phase velocity of the parallel-plate waveguide indicated by the dashed line.

Further, in the equivalent circuit per unit cell 107 of the meta-material 110 shown in FIG. 5, since the stop band is shifted to the low-frequency side by lowering the series resonance frequency of the serial resonance circuit 111, the phase velocity in the passband appearing at the lowest-frequency side becomes low.

Figure 7:
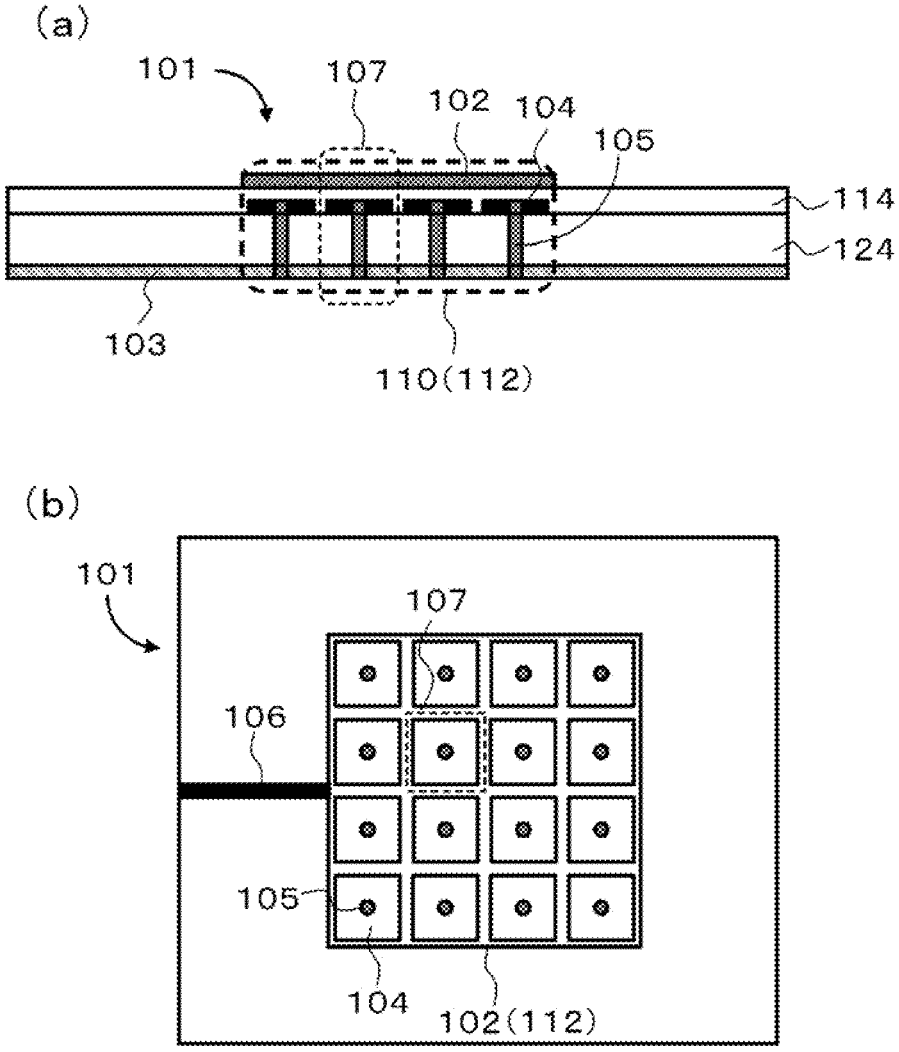
FIG. 7 is a diagram illustrating an embodiment of the resonator antenna according to the embodiment.

FIG. 7(*a*) shows a cross-sectional view illustrating a resonator antenna 101, and FIG. 7(*b*) shows a top view when it is seen through the upper surface. The resonator antenna 101 is formed of the conductor element 102 (second conductor), a conductor plane 103 (first conductor), the conductor strip 104 periodically arranged in a layer located between the conductor element 102 and the conductor plane 103, the conductor posts 105 that electrically connect the conductor plane 103 to each of the conductor strips 104, and a power feed line 106 electrically connected to the conductor element 102.

As shown in FIGS. 7(*a*) and 7(*b*), when the resonator antenna 101 is seen through the upper surface, a region occupied by the conductor element 102 is equivalent to a resonator 112, and the conductor strips 104 are periodically arranged within the region occupied by the conductor element 102.

The resonator 112 is formed of the meta-material 110 shown in FIG. 1. In an example shown in FIGS. 7(*a*) and 7(*b*), a case is shown in which the 4×4 unit cells 107 are arranged two-dimensionally. The lattice constant of the unit cell 107 is set to a, the shape of the resonator 112 becomes a square of one side of 4 a when seen from the upper surface.

Figure 2:
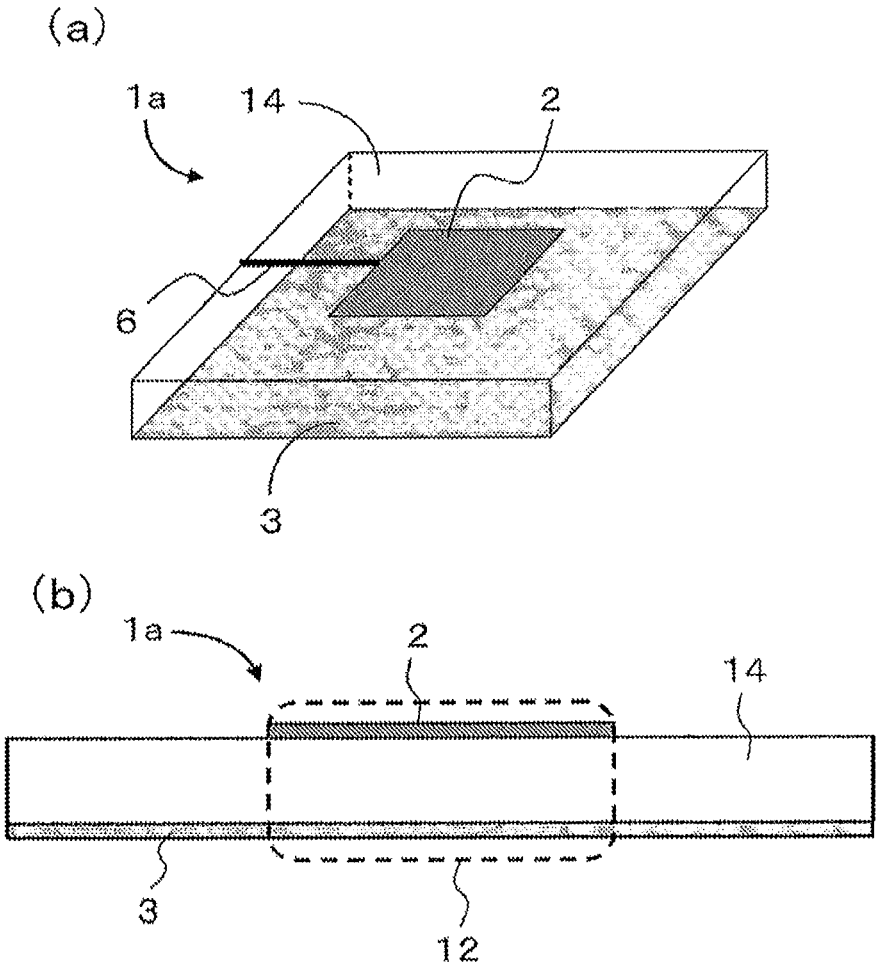
FIG. 2 (RELATED ART)
FIG. 2 is a diagram illustrating a related art type patch antenna 1*a*.
Figure 3:
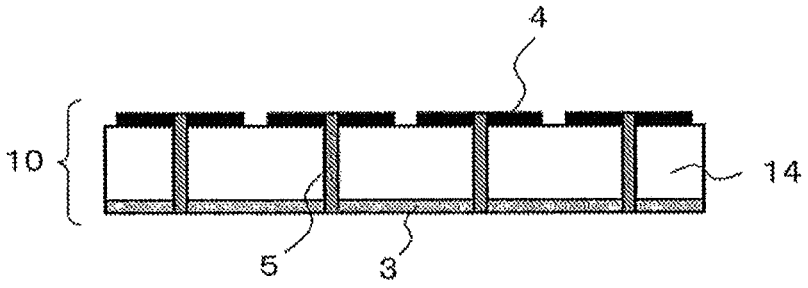
FIG. 3 (RELATED ART)
FIG. 3 is a cross-sectional view illustrating a mushroom-type periodic structure 10.
Figure 4:
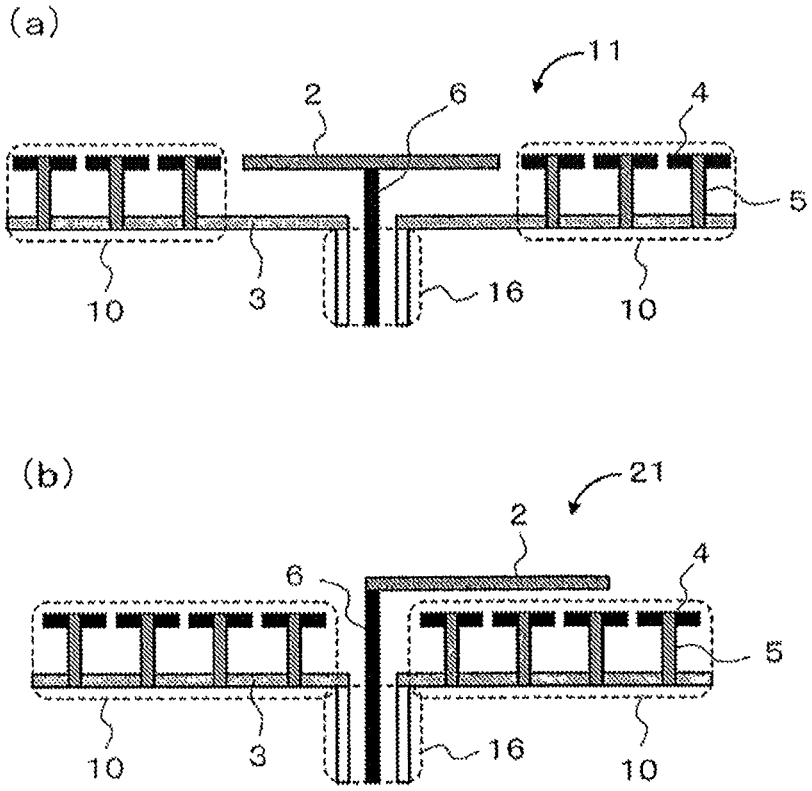
FIG. 4 (RELATED ART)
FIG. 4 is a diagram illustrating a resonator antenna in the related art in which the mushroom-type periodic structure 10 is used.

In a resonator 12 constituted by a square conductor having a length of Na of one side shown in FIG. 2, a dielectric layer, and a conductor plane, it is known that the frequency in wave number of $\beta=n\pi/(Na)$ (n=1, 2, . . . , N−1) on the dispersion curve is equivalent to the resonance frequency.

On the other hand, similarly with respect to the resonator 112 formed of the meta-material 110, when a resonator having a length of Na of one side is formed by arranging N×N unit cells 107 having a lattice constant of a two-dimensionally, the frequency in the wave number of $\beta=n\pi/(Na)$ (n=1, 2, . . . , N−1) on the dispersion curve is equivalent to the resonance frequency, and the frequency in, particularly, $\beta=\pi/(Na)$ is equivalent to the half-wavelength resonance frequency.

Figure 8:
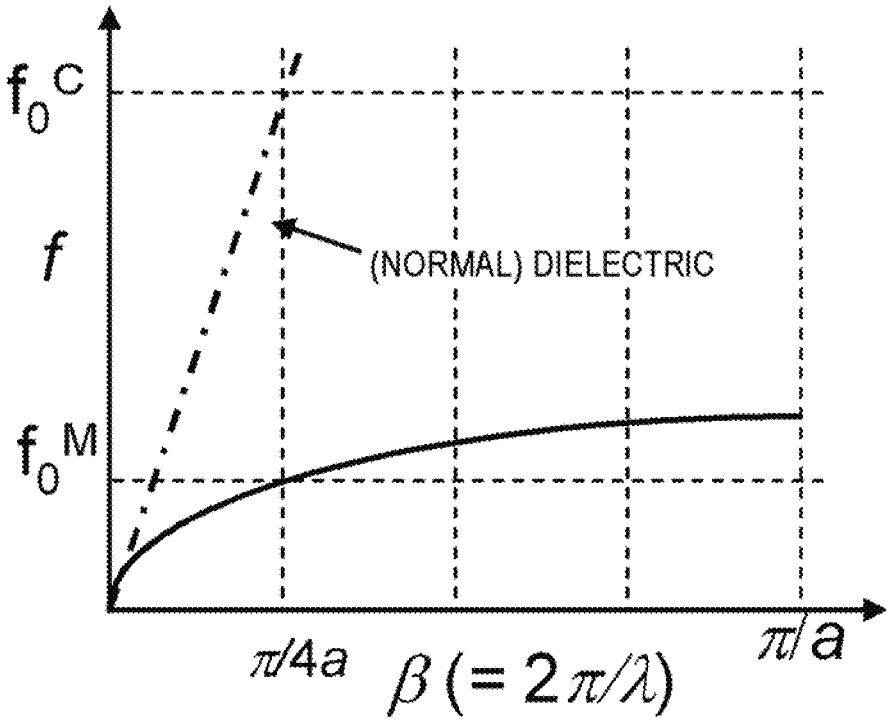
FIG. 8 is a dispersion curve of the meta-material for explaining the resonance frequency of the resonator antenna according to the embodiment.

When N=4, that is, when the length of one side of the resonator is 4 a, the frequency in $\beta=\pi/(4\ a)$ of the dispersion curve shown in FIG. 8 is equivalent to the half-wavelength resonance frequency. Here, it is known from FIG. 8 that the half-wavelength resonance frequency of f0C in the resonator 12 shown in FIG. 2 is much higher than the half-wavelength resonance frequency of f0M in the resonator 112 formed of the meta-material 110 shown in FIG. 7.

For this reason, if the half-wavelength resonance frequency in the resonator 12 is attempted to be made to be the same as the half-wavelength resonance frequency in the resonator 112 formed of the meta-material 110, it is meant that the length of one side of the resonator 12 has to be made f0C/f0M times larger with respect to the resonator 112 formed of the meta-material 110. That is, it is known that the resonator 112 formed of the meta-material 110 is a structure capable of being reduced in size to be smaller than the resonator 12 of the related art type patch antenna.

Meanwhile, in the resonator 112 shown in FIG. 7, an inter-layer via is used as the conductor post 105, but a through via 105*a* can also be used.

Figure 9:
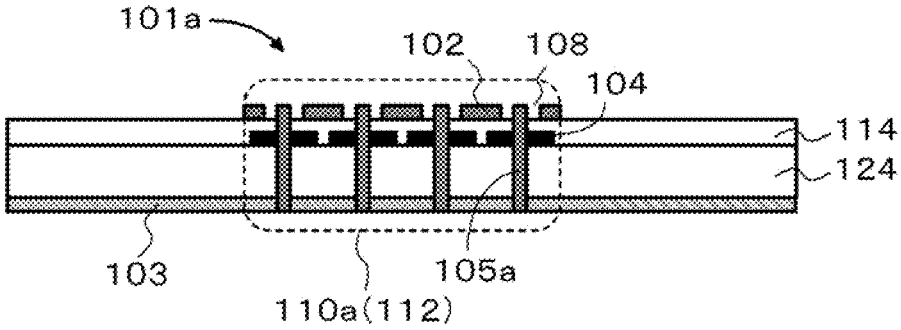
FIG. 9 is a cross-sectional view illustrating an example when a through via 105*a* is used as a connection member.
Figure 10:
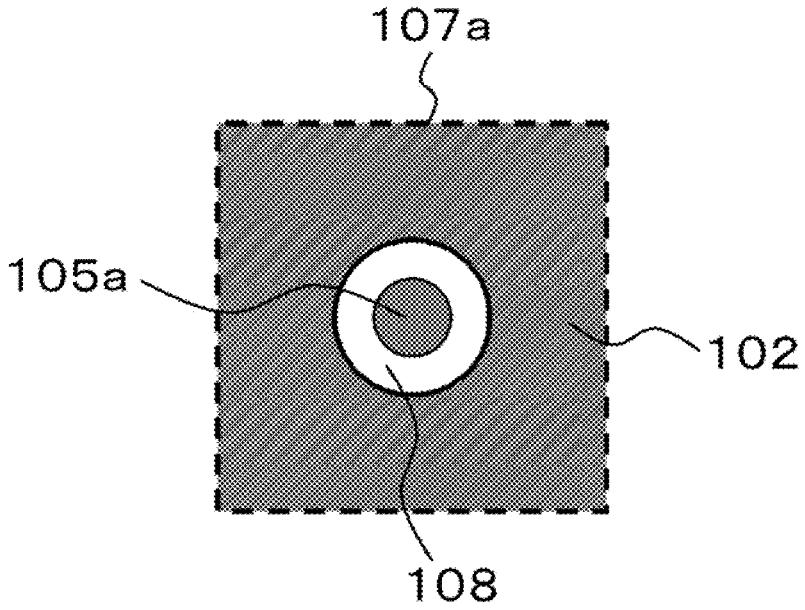
FIG. 10 is a top view illustrating a unit cell 107*a* of a conductor element in an embodiment of the resonator antenna shown in FIG. 9.

FIG. 9 shows a cross-sectional view illustrating a resonator antenna 101*a* when the through via 105*a* is used as the conductor post 105. In FIG. 9, an opening 108 is provided around the through via 105*a* within the layer of the conductor element 102 so that the conductor element 102 and the through via 105*a* are not electrically connected to each other. FIG. 10 is a top view illustrating a unit cell 107*a* of the conductor element 102, and shows a state in which the opening 108 is provided around the through via 105*a*.

The opening 108 is provided in this manner, whereby the equivalent circuit of the unit cell of the meta-material 110*a* constituting the resonator antenna 101*a* is expressed by the equivalent circuit shown in FIG. 5, and thus it is possible to miniaturize the resonator similarly to the structure shown in FIG. 7.

Although FIG. 7(*b*) shows a state in which the conductor strips 104 having a square shape are periodically arranged in a square lattice shape, a layout seen from the upper surface of the conductor strip 104 is not limited to the square shape shown in FIG. 7(*b*), and the method of arranging the conductor strips 104 is also not limited to the square lattice shape. For example, the conductor strips 104 having a regular hexagonal shape may be disposed in a triangular lattice shape.

Figure 24:
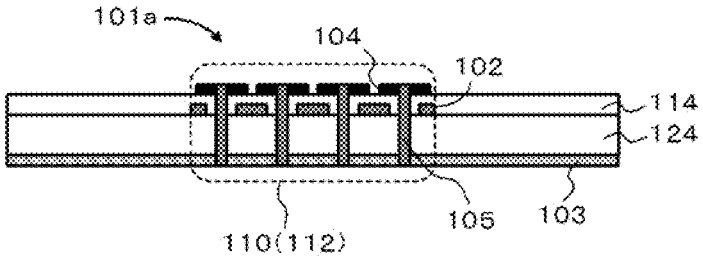
FIG. 24 is a cross-sectional view illustrating a modified example of the resonator antenna according to a first embodiment.
Figure 24:
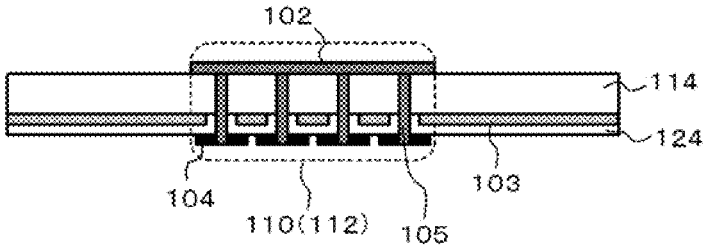

FIG. 24 is a cross-sectional view illustrating a modified example of the meta-material 110. Hereinafter, a description will be made of the portion different from the meta-material 110 shown in FIG. 1. In an example shown in FIG. 24(*a*), the conductor strip 104 is provided on the first dielectric layer 114. The conductor element 102 is provided on the second dielectric layer 124. The conductor element 102 is provided with an opening for passing the conductor post 105. Meanwhile, the conductor element 102 is provided only in the region in which the meta-material 110 is formed. In addition, the conductor plane 103 is provided not only in the region in which the meta-material 110 is formed, but also in the periphery thereof.

In the example shown in FIG. 24(*b*), a structure in which the meta-material 110 shown in FIG. 24(*a*) is turned upside down is shown. Specifically, the conductor element 102 is formed on the surface in the first dielectric layer 114 on which the second dielectric layer 124 is not provided. In addition, the conductor plane 103 is formed on the surface in the first dielectric layer 114 on which the second dielectric layer 124 is provided. In addition, the conductor strip 104 is provided on the surface in the second dielectric layer 124 which does not face the first dielectric layer 114. In addition, the conductor element 102 is not provided with an opening, and instead, the conductor plane 103 is provided with an opening. The conductor post 105 passes through the opening provided in the conductor plane 103, and connects the conductor element 102 and the conductor strip 104 to each other.

Meanwhile, in the example shown in FIGS. 24(*a*) and 24(*b*), the conductor strip 104 is not required to be provided in the outermost surface of the substrate of the antenna. In addition, although a through via is used as the conductor post 105 in each drawing of FIG. 24, another structure, for example, a configuration in which an interconnect is provided therebetween may be used.

(Second Embodiment)

In order to achieve further miniaturization of the resonator, a plane-type inductance element 109 can also be introduced. Because of the presence of the plane-type inductance element 109, the meta-material 210 used in a resonator antenna 201 according to a second embodiment of the invention more drastically increases in the inductance L in the equivalent circuit per unit cell shown in FIG. 5 and more decreases in the series resonance frequency of the serial resonance circuit 111 than the meta-material 110 used in the resonator antenna 101 according to the first embodiment of the invention. As a result, since the stop band is shifted to the low-frequency side, the phase velocity in the passband appearing at the lowest-frequency side is reduced, and the resonator can be miniaturized.

Figure 11:
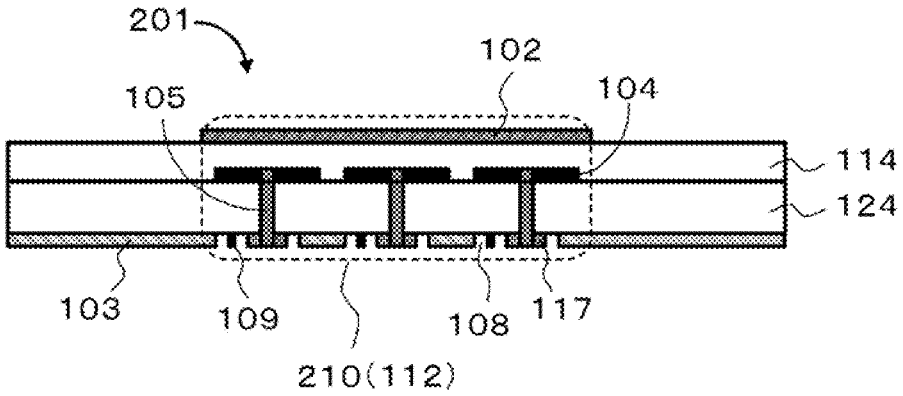
FIG. 11 is a cross-sectional view illustrating the resonator antenna according to a second embodiment.

FIG. 11 shows a cross-sectional view illustrating the resonator antenna 201 according to the second embodiment of the invention. In comparison with the cross-sectional view of the resonator antenna 101 according to the first embodiment of the invention shown in FIG. 7(*a*), the resonator antenna 201 according to the second embodiment of the invention is different from the resonator antenna 101 according to the first embodiment of the invention, in that the conductor plane 103 is periodically provided with the openings 108 and island-shaped electrodes 117 and the plane-type inductance elements 109 are provided within each of the openings 108.

Figure 12:
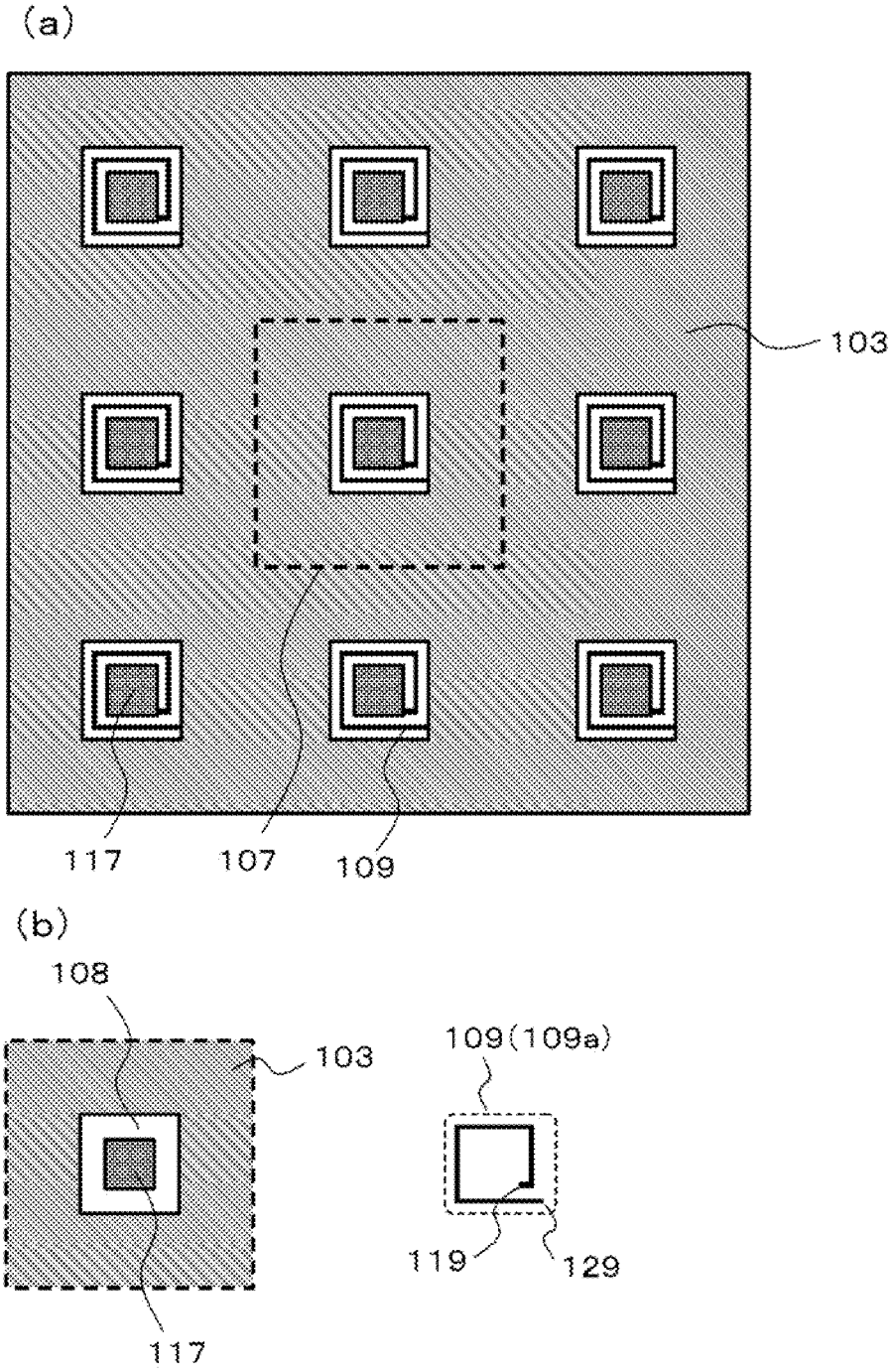
FIG. 12 is a top view illustrating a layout inside a resonator of a conductor plane layer constituting the resonator antenna according to the second embodiment.

FIG. 12(*a*) is a top view illustrating a layout inside the resonator 112 of the layer of the conductor plane 103 constituting the resonator antenna 201 according to the second embodiment of the invention. Further, FIG. 12(*b*) is an exploded top view illustrating each component constituting the layer of the conductor plane 103 of the unit cell 107 in FIG. 12(*a*).

As shown in FIG. 12(*a*), the plane-type inductance element 109 formed by an interconnect-shaped conductor, the island-shaped electrode 117, and the conductor plane 103 are formed in the same conductor layer as a continuous pattern. A first terminal 119 which is one of the two terminals existing in the plane-type inductance element 109 and the island-shaped electrode 117 are continuous with each other, and a second terminal 129 which is the other of the two terminals existing in the plane-type inductance element 109 and the conductor plane 103 having an opening are continuous with each other.

On the other hand, the island-shaped electrode 117 and each conductor strip 104 are electrically connected to each other by the conductor post 105. Thereby, the conductor strip 104 and the conductor plane 103 are electrically connected to each other through the conductor post 105, the island-shaped electrode 117, and the plane-type inductance element 109.

In this manner, the conductor plane 103, the plane-type inductance element 109, and the island-shaped electrode 117 are patterned and formed in the same conductor layer, whereby it is possible to increase the inductance L without making the conductor post longer. Therefore, it is possible to realize thinning and miniaturization of the resonator 112. In addition, it is possible to increase the inductance L without increasing the number of conductor layers, and to suppress the manufacturing costs.

Figure 13A:
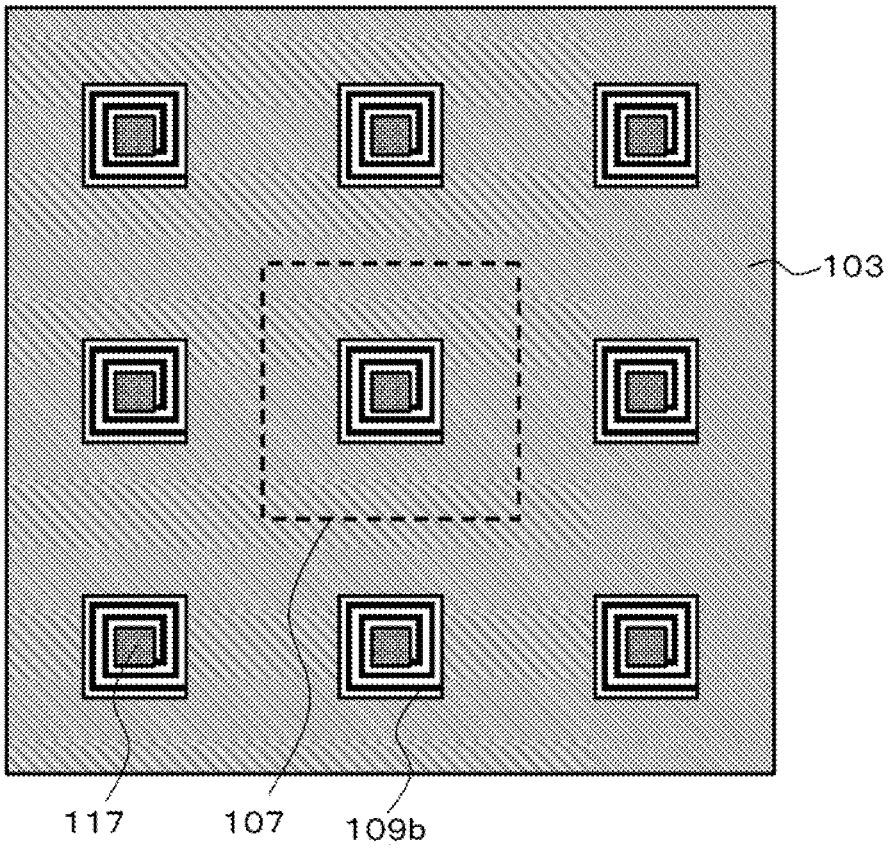
FIG. 13(*a*) is a top view illustrating various shapes of a plane-type inductance element.
Figure 13B:
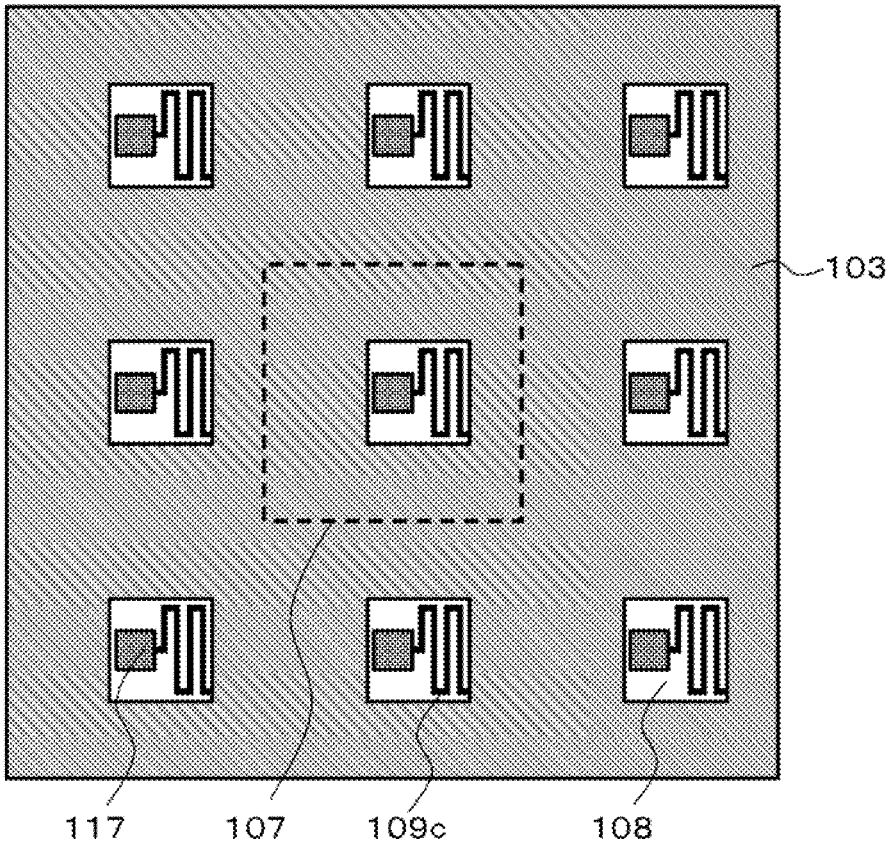
Figure 13C:
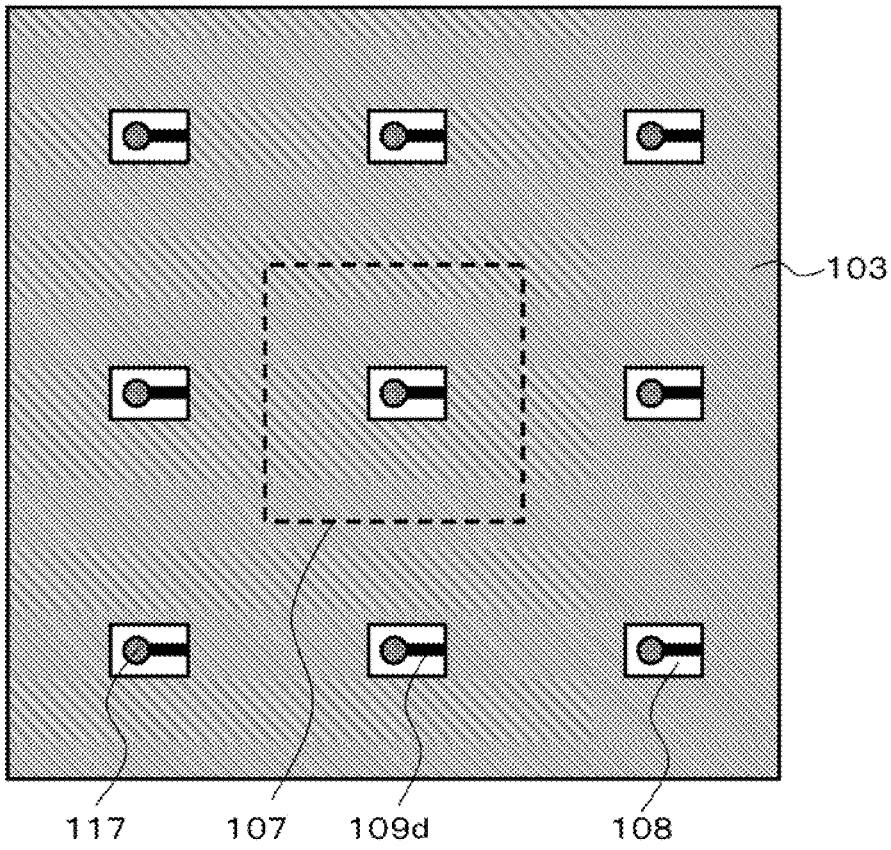

Here, although the example of FIGS. 12(*a*) and 12(*b*) shows a state in which the plane-type inductance element 109 is formed by a loop coil 109*a*, it is also possible to increase the inductance L by using a broken line-shaped conductor interconnect other than the loop coil 109*a* as the plane-type inductance element 109. FIG. 13(*a*) is a top view illustrating a layout of the layer of the conductor plane 103 inside the resonator 112 when a spiral coil 109*b* is used as the plane-type inductance element 109, FIG. 13(*b*) is a top view illustrating the layout mentioned above when a meander coil 109*c* is used as the plane-type inductance element 109, and FIG. 13(*c*) is a top view illustrating the layout mentioned above when a linear interconnect 109*d* is used as the plane-type inductance element 109. A broken line-shaped conductor interconnect having a shape other than those shown herein may be used.

Meanwhile, when the resonator antenna 201 according to the second embodiment of the invention is seen through the upper surface, a region occupied by the conductor element 102 is equivalent to the resonator 112, and the conductor strips 104 are periodically arranged within the region occupied by the conductor element 102.

The layout seen from the upper surface of the conductor strip 104 is not limited to the square shape shown in FIG. 7(*b*), and the method of arranging the conductor strips 104 is also not limited to the square lattice shape. For example, the conductor strips 104 having a regular hexagonal shape may be disposed in a triangular lattice shape.

Figure 25:
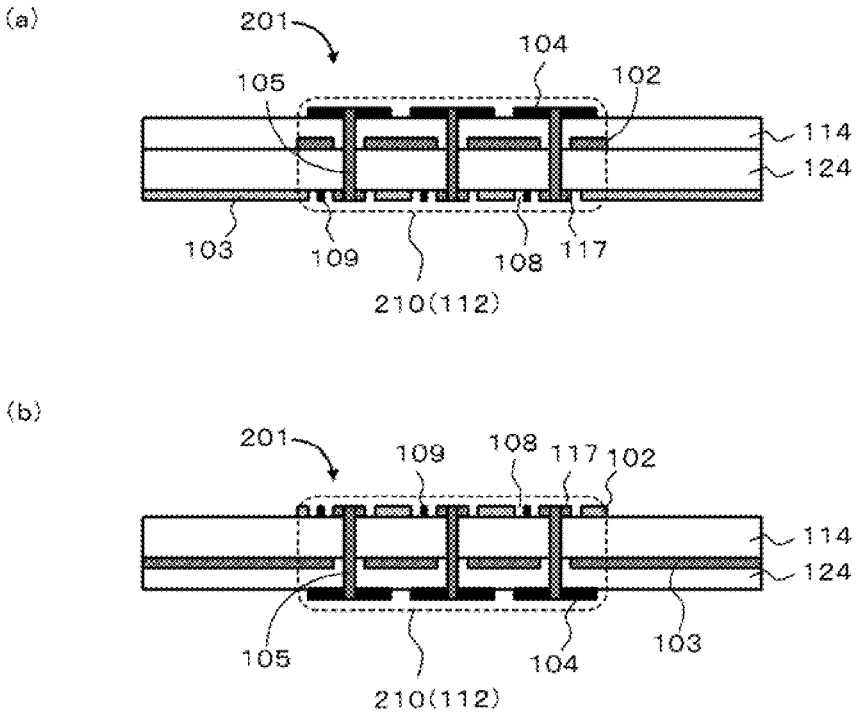
FIG. 25 is a cross-sectional view illustrating a modified example of the resonator antenna according to a second embodiment.

FIG. 25 is a cross-sectional view illustrating a modified example of the meta-material 210. Hereinafter, a description will be made of the portion different from the meta-material 210 shown in FIG. 11. In an example shown in FIG. 25(*a*), a layer provided with the conductor element 102 and a layer provided with the conductor strip 104 are interchanged with each other. That is, the conductor element 102 is provided on the surface in the first dielectric layer 114 which faces the second dielectric layer 124, and the conductor strip 104 is provided on the surface in the first dielectric layer 114 which does not face the second dielectric layer 124. The conductor element 102 is provided with an opening for passing a conductor post 115.

In the example shown in FIG. 25(*b*), a layer provided with the conductor strip 104 and a layer provided with the plane-type inductance element 109 are interchanged with each other with respect to the example shown in FIG. 25(*a*). That is, the conductor strip 104 is provided on the surface in the second dielectric layer 124 which does not face the first dielectric layer 114. In addition, the plane-type inductance element 109 is provided on the surface in the first dielectric layer 114 which does not face the second dielectric layer 124. In addition, the island-shaped electrode 117 is provided on the first dielectric layer 114.

(Third Embodiment)

Figure 14:
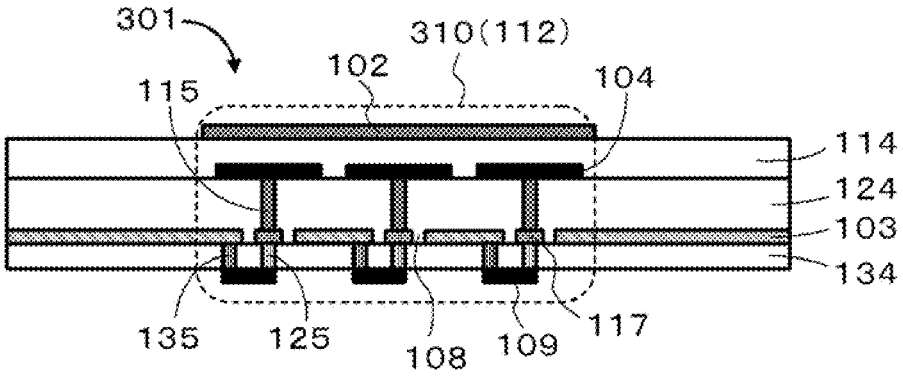
FIG. 14 is a cross-sectional view illustrating a resonator antenna according to a third embodiment.

It is also possible to provide the plane-type inductance element in the conductor layer distinct from the conductor plane. FIG. 14 shows a cross-sectional view illustrating a resonator antenna 301 according to a third embodiment of the invention. A meta-material 310 used in the resonator antenna 301 according to the third embodiment of the invention is constituted by four conductor layers. With this, the resonator antenna 301 according to the third embodiment is also constituted by a total of four conductor layers of a layer provided with the conductor element 102 which is an antenna element, a layer in which the periodic array of the conductor strips 104 is formed, a layer of the conductor plane 103 periodically provided with the openings 108, and a layer in which the plane-type inductance element 109 is formed.

The first dielectric layer 114 is interposed between the layer provided with the conductor element 102 and the layer in which the periodic array of the conductor strips 104 is formed, the second dielectric layer 124 is interposed between the layer in which the periodic array of the conductor strips 104 is formed and the layer of the conductor plane 103, and a third dielectric layer 134 is further interposed between the layer of the conductor plane 103 and the layer in which the plane-type inductance element 109 is formed.

Figure 15:
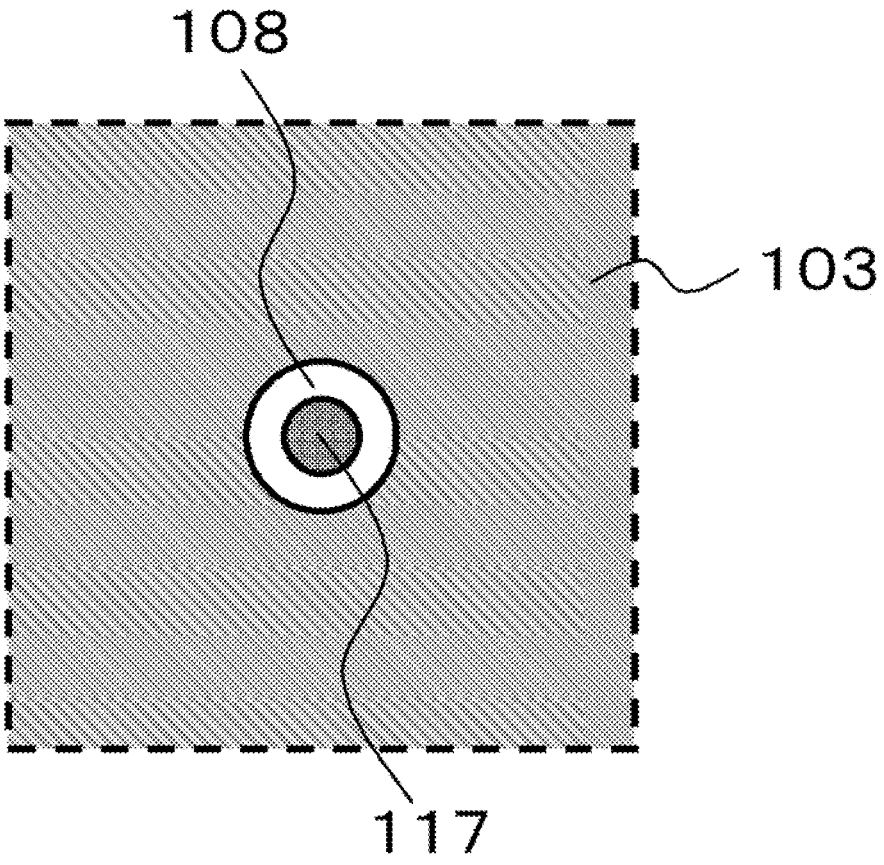
FIG. 15 is a top view illustrating a layout of the conductor plane layer per meta-material unit cell.
Figure 16A:
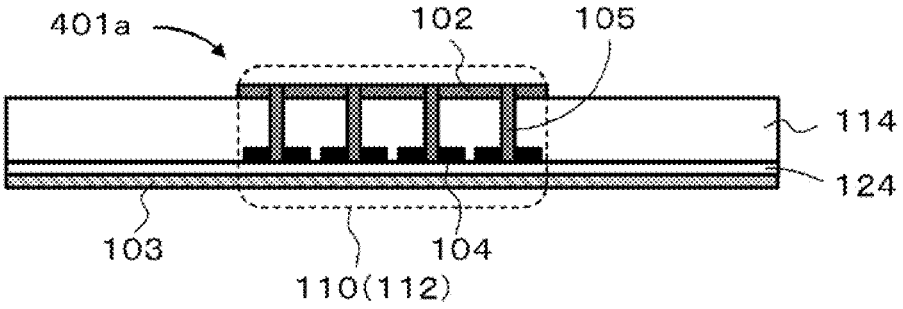
FIG. 16(*a*) is a cross-sectional view illustrating the resonator antenna according to a fourth embodiment.
Figure 16B:
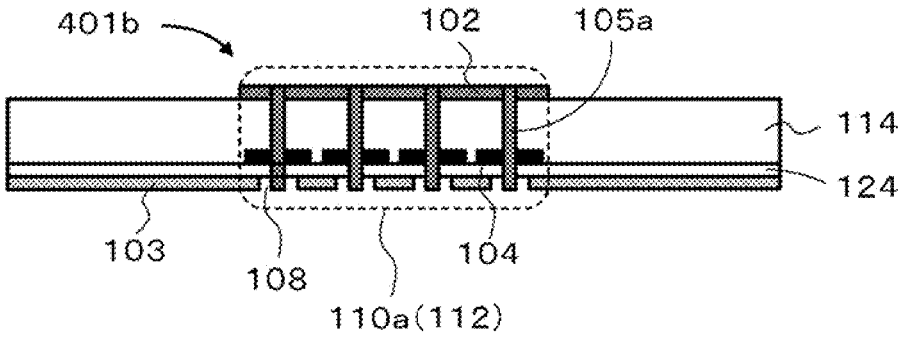
Figure 16C:
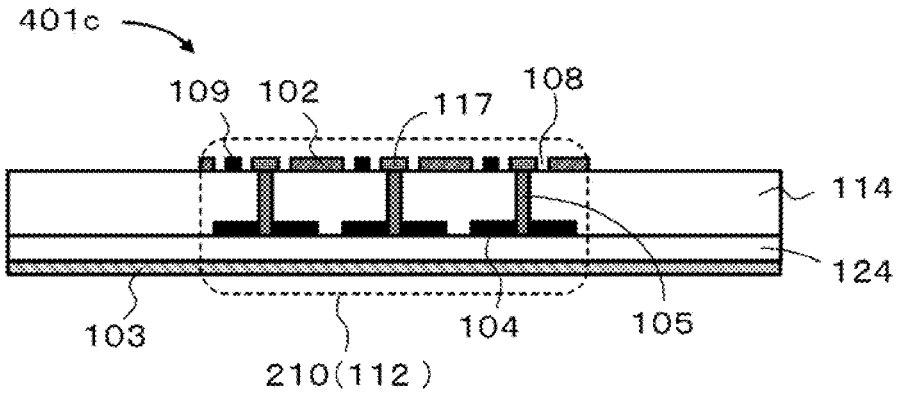
Figure 16D:
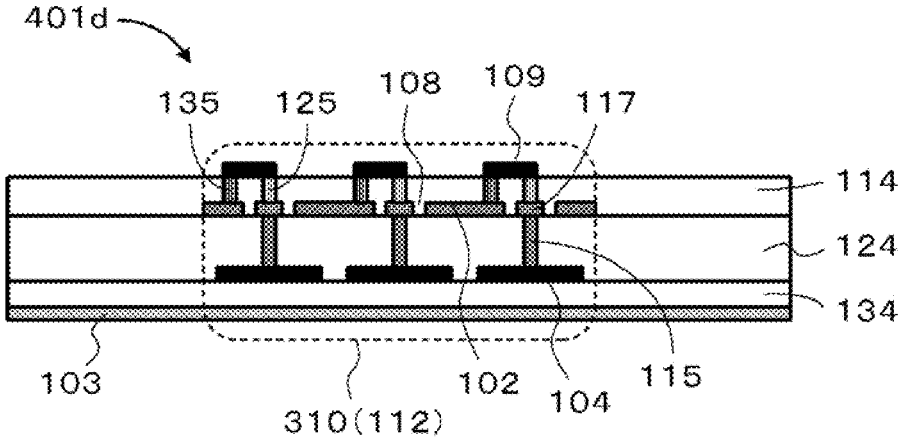

The island-shaped electrode 117 is provided within each of the openings 108 of the conductor plane 103, and the conductor plane 103 and the island-shaped electrode 117 are formed in the same conductor layer. FIG. 15 is a top view illustrating a layout of the layer of the conductor plane 103 per unit cell of the meta-material 310. The plane-type inductance element 109 is formed in a layer distinct from the layer of the conductor plane 103. Therefore, FIG. 15 shows a layout in which the loop coil 109*a* is removed in comparison with the second embodiment of the invention shown in FIG. 12(*a*).

As shown in FIG. 14, each conductor strip 104 is electrically connected to the island-shaped electrode 117 by the first conductor post 115. In addition, the island-shaped electrode 117 is electrically connected to the first terminal 119 which is one of the two terminals existing in the plane-type inductance element 109, formed in the lowermost layer in FIG. 14, by a second conductor post 125. Further, the second terminal 129 which is the other terminal of the two terminals existing in the plane-type inductance element 109 and the conductor plane 103 having an opening are connected to each other by a third conductor post 135.

In this manner, the plane-type inductance element 109 is formed in the layer distinct from the conductor plane 103, whereby it is possible to make the coil larger while the number of conductor layers increases, and to increase the inductance L.

It is possible to use the loop coil 109*a*, the spiral coil 109*b*, the meander coil 109*c*, the linear interconnect 109*d*, and the broken line-shaped conductor interconnect having another shape, or the like, as the plane-type inductance element 109.

Meanwhile, when the resonator antenna 301 according to the third embodiment of the invention is seen through the upper surface, a region occupied by the conductor element 102 is equivalent to the resonator 112, and the conductor strips 104 are periodically arranged within the region occupied by the conductor element 102.

The layout seen from the upper surface of the conductor strip 104 is not limited to the square shape shown in FIG. 7(*b*), and the method of arranging the conductor strips 104 is also not limited to the square lattice shape. For example, the conductor strips 104 having a regular hexagonal shape may be disposed in a triangular lattice shape.

Figure 26:
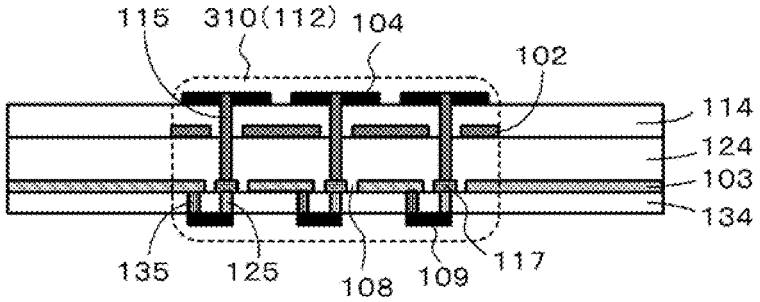
FIG. 26 is a cross-sectional view illustrating a modified example of the resonator antenna according to the third embodiment.
Figure 26:
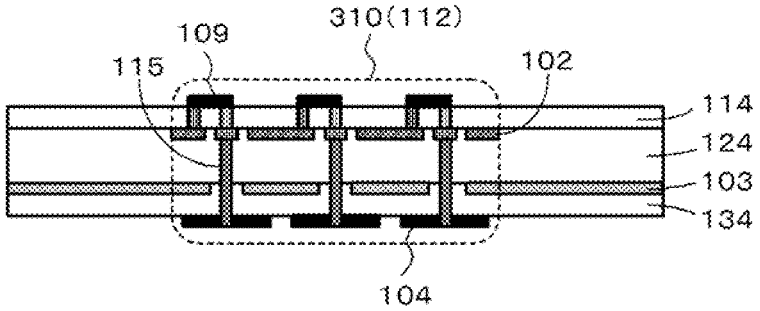

FIG. 26 is a cross-sectional view illustrating a modified example of the meta-material 310. Hereinafter, a description will be made of the portion different from the meta-material 310 shown in FIG. 14. In an example shown in FIG. 26(*a*), a layer provided with the conductor element 102 and a layer provided with the conductor strip 104 are interchanged with each other. That is, the conductor element 102 is provided on the surface in the first dielectric layer 114 which faces the second dielectric layer 124, and the conductor strip 104 is provided on the surface in the first dielectric layer 114 which does not face the second dielectric layer 124. The conductor element 102 is provided with an opening for passing the first conductor post 115.

In the example shown in FIG. 26(*b*), a layer provided with the conductor strip 104 and a layer provided with the plane-type inductance element 109 are interchanged with each other with respect to the example shown in FIG. 26(*a*). That is, the conductor strip 104 is provided on the surface in the third dielectric layer 134 which does not face the second dielectric layer 124. In addition, the plane-type inductance element 109 is provided on the surface in the first dielectric layer 114 which does not face the second dielectric layer 124. The second conductor post 125 and the third conductor post 135 are provided in the first dielectric layer 114. In addition, the island-shaped electrode 117 is provided within an opening of the conductor element 102.

(Fourth Embodiment)

In the resonator antenna according to the first to third embodiments of the invention, although a structure is formed in which the conductor element 102 which is an antenna element is not electrically connected to the conductor post 105, a structure may be formed in which the conductor element 102 is electrically connected to the conductor post 105 by turning the layer configuration of the resonator 112 upside down. At this time, the equivalent circuit per unit cell is completely equivalent to that shown in FIG. 5 only by turning the layer configuration of the meta-material within the resonator 112 upside down.

FIG. 16(*a*) shows a cross-sectional view illustrating a resonator antenna 401*a* according to a fourth embodiment of the invention in which the meta-material 110 constituting the resonator antenna 101 according to the first embodiment of the invention is used. In the resonator antenna 401*a* according to the fourth embodiment of the invention, the conductor strip 104 constituting the meta-material 110 is electrically connected to the conductor element 102 through the conductor post 105. That is, the method of connecting the conductor post 105 is different from that in the resonator antenna 101 according to the first embodiment. However, both of them are completely equivalent to each other when represented by the equivalent circuit.

FIG. 16(*b*) shows a cross-sectional view illustrating a resonator antenna 401*b* according to the fourth embodiment of the invention in which the meta-material 110*a* constituting the resonator antenna 101*a* according to the first embodiment of the invention is used. In the resonator antenna 401*b* according to the fourth embodiment of the invention, the conductor strip 104 constituting the meta-material 110*a* is electrically connected to the conductor element 102 through the through via 105*a*. In addition, the conductor plane 103 within the resonator 112 is provided with the opening 108 around the through via 105*a* so that the conductor plane 103 and the through via 105*a* are not electrically connected to each other. That is, the method of connecting the through via 105*a* is different from that in the resonator antenna 101*a* according to the first embodiment. However, both of them are completely equivalent to each other when represented by the equivalent circuit.

FIG. 16(*c*) shows a cross-sectional view illustrating a resonator antenna 401*c* according to the fourth embodiment of the invention in which the meta-material 210 constituting the resonator antenna 201 according to the second embodiment of the invention is used. In the resonator antenna 401*c* according to the fourth embodiment of the invention, the conductor element 102 is periodically provided with the openings 108, and the island-shaped electrode 117 and the plane-type inductance element 109 are provided within each of the openings 108. The layout when the conductor element 102 within the resonator 112 is seen from the upper surface is the same as the layout when the conductor plane within the region surrounded by the resonator 112 according to the second embodiment shown in FIG. 12(*a*) and FIGS. 13(*a*) to 13(*c*) is seen from the upper surface. The conductor strip 104 is electrically connected to the island-shaped electrode 117 through the conductor post 105.

The configuration in which the opening 108, the island-shaped electrode 117, and the plane-type inductance element 109 are provided not in the conductor plane 103 layer but in the layer of the conductor element 102 is different from that of the resonator antenna 201 according to the second embodiment, but both of them are completely equivalent to each other when represented by the equivalent circuit.

FIG. 16(*d*) shows a cross-sectional view illustrating a resonator antenna 401*d* according to the fourth embodiment of the invention in which the meta-material 310 constituting the resonator antenna 301 according to the third embodiment of the invention is used. In the resonator antenna 401*d* according to fourth embodiment of the invention, the first dielectric layer 114 is interposed between the layer provided with the plane-type inductance element 109 and the layer provided with the conductor element 102, the second dielectric layer 124 is interposed between the conductor element 102 and the layer in which the periodic array of the conductor strip 104 is formed, and the third dielectric layer 134 is interposed between the layer in which periodic array of the conductor strip 104 is formed and the layer of the conductor plane 103. In addition, the island-shaped electrode 117 is provided within each opening 108 of the conductor element 102, and the conductor element 102 and the island-shaped electrode 117 are formed in the same conductor layer.

The configuration in which the opening 108 and the island-shaped electrode 117 are provided not in the conductor plane 103 layer but in the layer of the conductor element 102, and the order of laminating each of the conductor layers are different from those of the resonator antenna 301 according to the third embodiment, but both of them are completely equivalent to each other when represented by the equivalent circuit.

Meanwhile, the layout seen from the upper surface of the conductor strip 104 is not limited to the square shape shown in FIG. 7(*b*), and the method of arranging the conductor strips 104 is not limited to the square lattice shape. For example, the conductor strips 104 having a regular hexagonal shape may be disposed in a triangular lattice shape.

Figure 17:
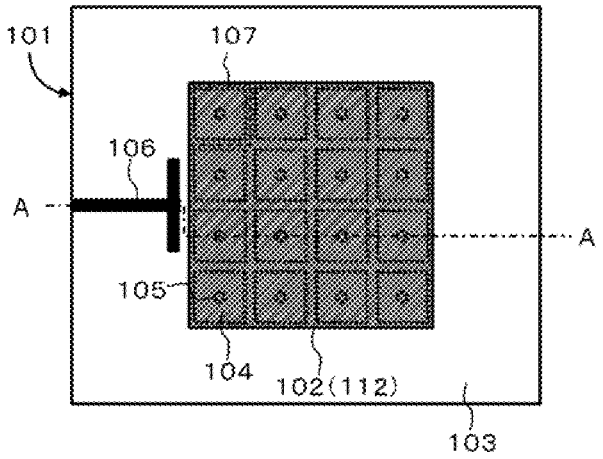
FIG. 17(*a*) is a top view illustrating the resonator antenna according to a fifth embodiment, and FIG. 17(*b*) is a cross-sectional view taken along the line A-A of FIG. 17(*a*).
Figure 17:
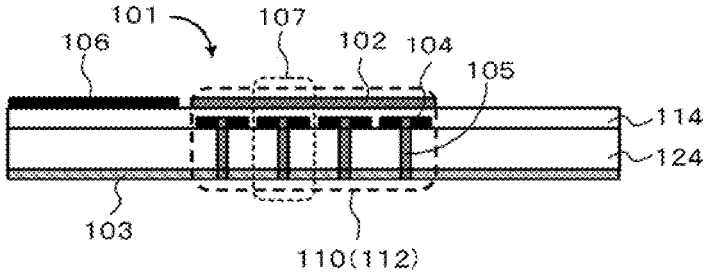

FIG. 17(*a*) is a top view illustrating a configuration of the antenna according to a fifth embodiment, and FIG. 17(*b*) is a cross-sectional view taken along the line A-A of FIG. 17(*a*). This antenna is a resonator-type antenna, and constitutes the resonator using the meta-material 110 shown in the first embodiment.

In the embodiment, the power feed line 106 of the antenna is provided in same layer as the conductor element 102 is provided in, and is capacitively coupled to the conductor element 102. The power feed line 106 has an auxiliary pattern. This auxiliary pattern is provided in the portion facing the conductor element 102. Meanwhile, the power feed line 106 may be coupled to the conductor element 102 by a method other than the capacitive coupling. For example, the power feed line 106 may be directly connected to the conductor element 102.

In addition, the conductor plane 103 is also provided below the power feed line 106. The microstrip line is constituted by the power feed line 106 and the conductor plane 103.

According to the embodiment, since the meta-material 110 shown in FIG. 1 is used, it is possible to miniaturize the antenna. In addition, since the power feed line 106 can be provided in the same layer as the conductor element 102 is provided in, the structure of the antenna is simplified. Meanwhile, the structure of the meta-material is not limited to the example shown. in the drawing, and the meta-material shown in, for example, FIGS. 9, 11, 14, and 15 can be used.

Figure 18:
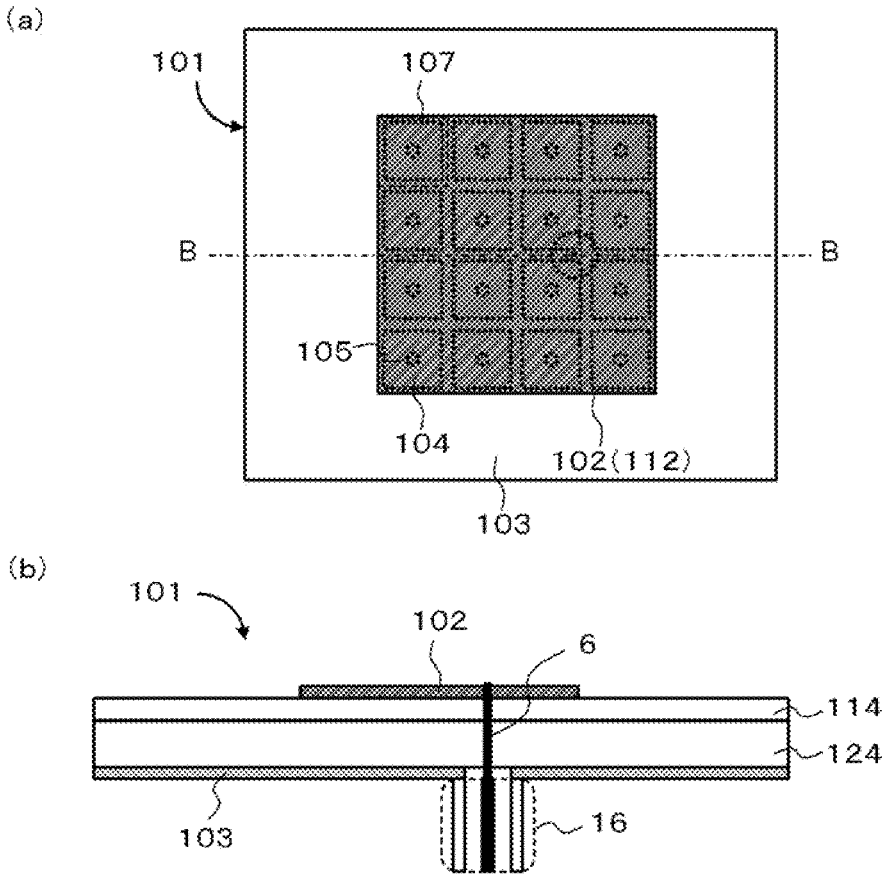
FIG. 18(*a*) is a top view illustrating the resonator antenna according to a sixth embodiment, and FIG. 18(*b*) is a cross-sectional view taken along the line B-B of FIG. 18(*a*).

FIG. 18 is a top view illustrating a configuration of the antenna according to a sixth embodiment, and FIG. 18(*b*) is a cross-sectional view taken along the line B-B of FIG. 18(*a*). This antenna has the same configuration as that of the antenna according to the fifth embodiment, except that a coaxial cable 16 and a power feed line 6 are provided in place of the power feed line 106. An internal conductor of the coaxial cable 16 is connected to the conductor element 102 through the power feed line 6. In detail, the conductor plane 103 is provided with an opening, and the coaxial cable 16 is installed in this opening. The internal conductor of the coaxial cable 16 is connected to the conductor element 102 through the power feed line 6 having a through via shape provided in a region which overlaps the opening. In addition, an external conductor of the coaxial cable 16 is connected to the conductor plane 103.

It is also possible to miniaturize the antenna in the embodiment since the meta-material 110 shown in FIG. 1 is used. Meanwhile, the structure of the meta-material is not limited to the example shown in the drawing, and the meta-material shown in, for example, FIGS. 9, 11, 14, and 15 can be used.

Figure 19:
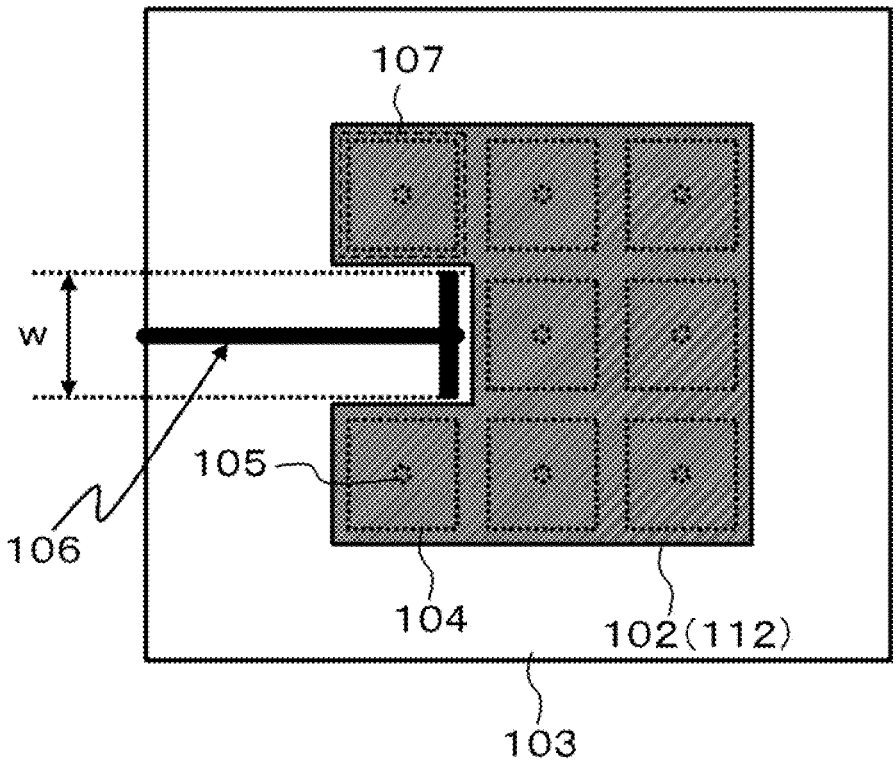
FIG. 19 is atop view illustrating the resonator antenna according to a seventh embodiment.

FIG. 19 is a top view illustrating a configuration of the antenna according to a seventh embodiment. This antenna has the same configuration as that of the antenna according to the fifth embodiment, except for the following respects. First, the lattice represented by the arrangement of the unit cells 107 has a lattice defect. This lattice defect is located at the center of the side to which the power feed line 106 in the lattice is connected. The power feed line 106 is extended through the lattice defect, and is capacitively coupled to conductor element 102 constituting the unit cell 107 located at the inner side from the outermost circumference. Meanwhile, the power feed line 106 may be coupled to the conductor element 102 by a method other than the capacitive coupling. For example, the power feed line 106 may be directly connected to the conductor element 102.

It is also possible to obtain the same effect as that of the fifth embodiment in the embodiment. In addition, it is possible to adjust the input impedance of the antenna by adjusting the position and the number of lattice defects. Meanwhile, the structure of the meta-material is not limited to the example of the drawing, and the meta-material shown in, for example, FIGS. 9, 11, 14, and 15 can be used.

Figure 20:
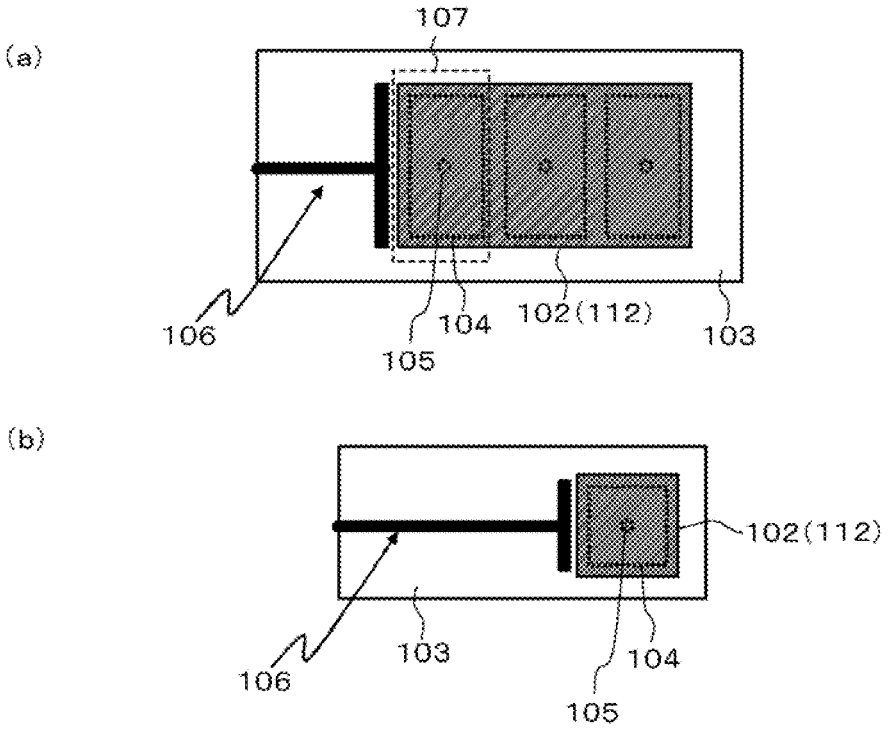
FIG. 20 is a top view illustrating the resonator antenna according to an eighth embodiment.
Figure 21:
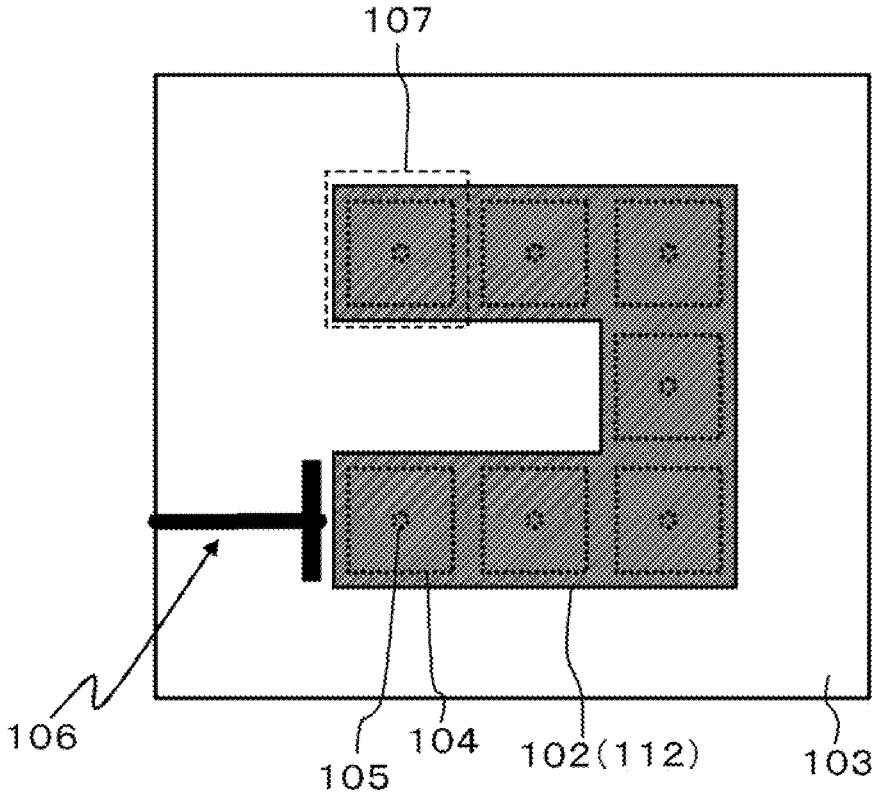
FIG. 21 is a top view illustrating the resonator antenna according to the eighth embodiment.

FIGS. 20 and 21 are top views illustrating a configuration of the antenna according to an eighth embodiment. This antenna has the same configuration as that of the structure of the fifth embodiment, except that the meta-material is formed by the one-dimensional array of the unit cell 107.

In the example shown in FIG. 20(*a*), the conductor strip 104 is rectangular. The unit cells 107 are disposed along a straight line. The power feed line 106 faces the long side of the conductor strip 104. In addition, in the example shown in FIG. 20(*b*), the structure is formed by one unit cell 107.

In addition, in the example shown in FIG. 21, the unit cells 107 are disposed along the line having a bending portion.

It is also possible to obtain the same effect as that of the fifth embodiment in the embodiment. Meanwhile, the structure of the meta-material is not limited to the example shown in the drawing, and the meta-material shown in, for example, FIGS. 9, 11, 14, and 15 can be used.

Figure 22:
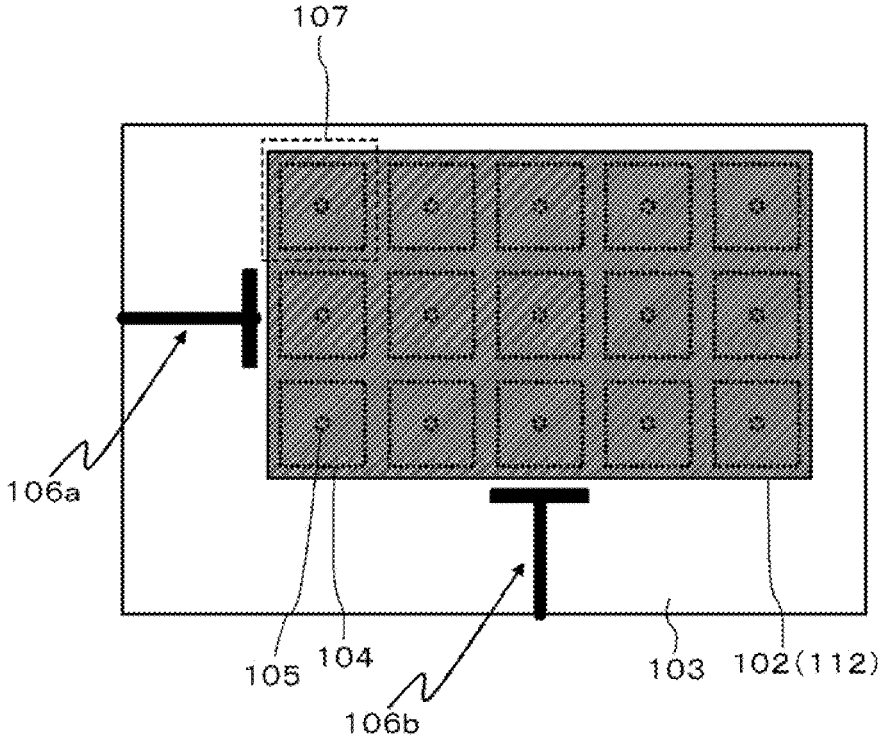
FIG. 22 is a top view illustrating the resonator antenna according to a ninth embodiment.

FIG. 22 is a top view illustrating a configuration of the antenna according to a ninth embodiment. This antenna has the same configuration as that of the antenna according to the fifth embodiment, except for the following respects. First, a plurality of conductor strips 104, that is, the unit cells 107 are periodically arranged two-dimensionally so as to form the rectangular lattice. Specifically, the unit cell 107 is square, and the number of unit cells 107 forming the long side thereof is larger than the number of unit cells 107 forming the short side thereof. A first power feed line 106*a* is capacitively coupled to the portion located at the short side of the lattice in the conductor element 102. In addition, a second power feed line 106*b* is capacitively coupled to the portion located at the long side of the lattice in the conductor element 102. Meanwhile, the power feed line 106 may be coupled to the conductor element 102 by a method other than the capacitive coupling. For example, the power feed line 106 may be directly connected to the conductor element 102.

It is also possible to obtain the same effect as that of the fifth embodiment in the embodiment. In addition, the unit cell 107 is periodically arranged two-dimensionally so as to form the rectangular lattice, and the first power feed line 106*a* and the second power feed line 106*b* are capacitively coupled to the short side and the long side of this lattice, respectively. In the resonator of the antenna, the resonance frequency in the direction of the rectangular short side and the resonance frequency in the direction of the long side are different from each other. For this reason, it is possible to dual-band the antenna. Meanwhile, the structure of the meta-material is not limited to the example shown in the drawing, and the meta-material shown in, for example, FIGS. 9, 11, 14, and 15 can be used.

Figure 23:
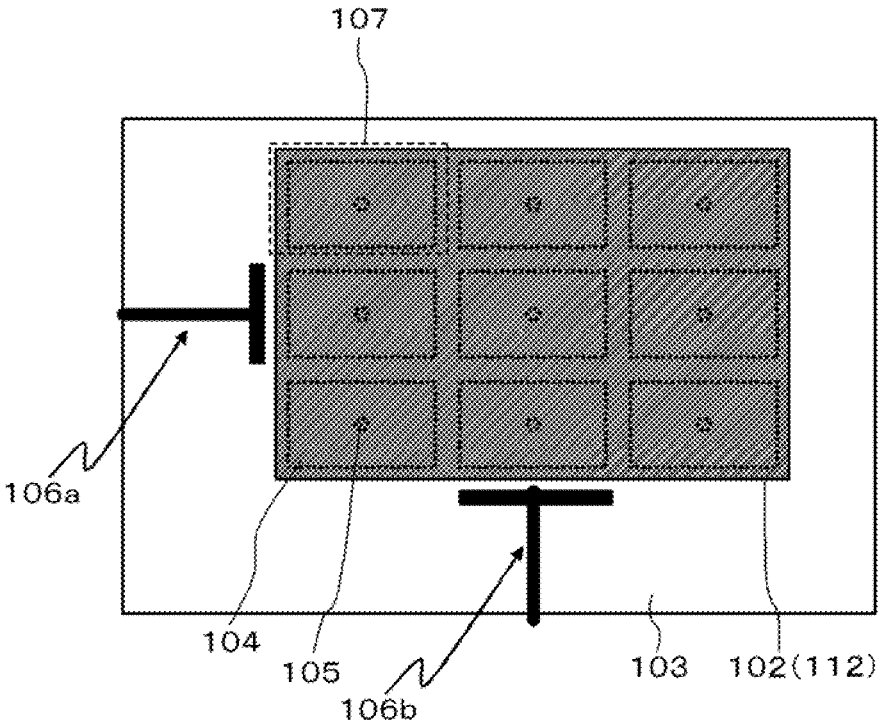
FIG. 23 is a top view illustrating the resonator antenna according to a tenth embodiment.

FIG. 23 is a top view illustrating a configuration of the antenna according to a tenth embodiment. This antenna has the same configuration as that of the antenna according to the ninth embodiment, except that the unit cell 107, that is, the conductor strip 104 is formed to be rectangular, and that the rectangular lattice is formed by setting the numbers of unit cells 107 forming each of the sides to be equal to each other.

Even in the embodiment, the dispersion curve of electromagnetic waves propagating through the direction of the long side of the lattice and the dispersion curve of electromagnetic waves propagating through the direction of the short side of the lattice are different from each other. For this reason, it is possible to dual-band the antenna. Meanwhile, the structure of the meta-material is not limited to the example shown in the drawing, and the meta-material shown in, for example, FIGS. 9, 11, 14, and 15 can be used.

The application is based on Japanese Patent Application No. 2009-081858 filed on Mar. 30, 2009, the content of which is corporate herein by reference.

Description of Reference Numerals and Signs

1*a*: PATCH ANTENNA
2, 102: CONDUCTOR ELEMENT
3, 103: CONDUCTOR PLANE
4, 104: CONDUCTOR STRIP
5, 105: CONDUCTOR POST
6, 106, 106*a*, 106*b*: POWER FEED LINE
10: MUSHROOM-TYPE PERIODIC STRUCTURE
11: PATCH ANTENNA
12, 112: RESONATOR
14: DIELECTRIC LAYER
16: COAXIAL CABLE
21: WIRE ANTENNA
101, 101*a*, 201, 301, 401*a*, 401*b*, 401*c*, 401*d*: RESONATOR ANTENNA
105*a*: THROUGH VIA
107, 107*a*: UNIT CELL
108: OPENING
109: PLANE-TYPE INDUCTANCE ELEMENT
109*a*: LOOP COIL
109*b*: SPIRAL COIL
109*c*: MEANDER COIL
109*d*: LINEAR INTERCONNECT
110, 110*a*, 210, 310: META-MATERIAL
111: SERIAL RESONANCE CIRCUIT
113: FIRST CONDUCTOR PLANE
114: FIRST DIELECTRIC LAYER
115: FIRST CONDUCTOR POST
117: ISLAND-SHAPED ELECTRODE
119: FIRST TERMINAL
123: SECOND CONDUCTOR PLANE
124: SECOND DIELECTRIC LAYER
125: SECOND CONDUCTOR POST

129: SECOND TERMINAL
134: THIRD DIELECTRIC LAYER
135: THIRD CONDUCTOR POST

The invention claimed is:

1. A resonator antenna comprising:

a first conductor;

a second conductor of which at least a portion faces the first conductor;

third conductors periodically arranged within an area where the first conductor and the second conductor face each other;

a power feed line electrically connected to the first conductor or the second conductor;

first connection members that electrically connect the third conductors and the first conductor to each other;

openings repeatedly provided in the first conductor;

an island-shaped electrode provided in each of the openings; and an inductance element that electrically connects the island-shaped electrode and the first conductor, wherein respective portions of the first conductor and the second conductor which face each other, the third conductors, and the first connection members constitute at least a portion of a resonator, wherein the first connection member electrically connects the third conductor and the island-shaped electrode, and wherein a width of the island-shaped electrode is larger than widths of the first connection member and the inductance element in a planar view.

2. The resonator antenna according to claim 1, wherein the inductance element is a plane-type inductance element, the plane-type inductance element and the island-shaped electrode are formed in the same conductor layer as the first conductor having the opening, one terminal included in the plane-type inductance element is connected to the first conductor having the opening, and the other terminal included in the plane-type inductance element is connected to the island-shaped electrode.

3. The resonator antenna according to claim 1, further comprising:

a conductor layer in which the inductance element is formed;

a second connection member that connects one terminal included in the inductance element and the island-shaped electrode to each other; and a third connection member that electrically connects the other terminal included in the inductance element and the first conductor having the opening.

4. The resonator antenna according to claim 3, wherein the inductance element is a plane-type inductance element.

5. The resonator antenna according to claim 1, wherein an interconnect-shaped conductor is used as the inductance element.

6. The resonator antenna according to claim 1, wherein the inductance element is a meander coil, a loop coil, or a spiral coil.

7. The resonator antenna according to claim 1, wherein the plurality of third conductors is periodically arranged two-dimensionally so as to form a rectangular lattice, and includes a first power feed line electrically connected to the first conductor or the second conductor in the short side of the lattice, and a second power feed line electrically connected to the first conductor or the second conductor in the long side of the lattice.

8. The resonator antenna according to claim 1, wherein the plurality of first conductors is rectangular, and is periodically arranged two-dimensionally so as to form a lattice, and includes a first power feed line electrically connected to the first conductor or the second conductor in a first side of the lattice, and a second power feed line electrically connected to the first conductor or the second conductor in a second side intersecting the first side in the lattice.

* * * * *